US010260178B2

(12) United States Patent
Inagaki

(10) Patent No.: US 10,260,178 B2
(45) Date of Patent: Apr. 16, 2019

(54) METHOD FOR MANUFACTURING GLOVE, METHOD FOR MANUFACTURING COATED GLOVE, GLOVE, AND COATED GLOVE

(71) Applicant: SHOWA GLOVE CO., Hyogo (JP)

(72) Inventor: Toshio Inagaki, Hyogo (JP)

(73) Assignee: Showa Glove Co., Hyogo (JP)

( * ) Notice: Subject to any disclaimer, the term of this patent is extended or adjusted under 35 U.S.C. 154(b) by 702 days.

(21) Appl. No.: 14/379,629

(22) PCT Filed: Feb. 25, 2013

(86) PCT No.: PCT/JP2013/054811
§ 371 (c)(1),
(2) Date: Aug. 19, 2014

(87) PCT Pub. No.: WO2013/129336
PCT Pub. Date: Sep. 6, 2013

(65) Prior Publication Data

US 2015/0000349 A1 Jan. 1, 2015

(30) Foreign Application Priority Data

Mar. 1, 2012 (JP) ..... 2012-045909

(51) Int. Cl.
*D04B 1/28* (2006.01)
*A41D 19/015* (2006.01)
*A41H 43/00* (2006.01)

(52) U.S. Cl.
CPC ..... *D04B 1/28* (2013.01); *A41D 19/015* (2013.01); *A41H 43/00* (2013.01)

(58) Field of Classification Search
CPC ..... A41D 19/015; A41H 43/00; D04B 1/28; D04B 7/34; D04B 9/58
(Continued)

(56) References Cited

U.S. PATENT DOCUMENTS 2,311,133 A * 2/1943 Schuessler ..... A41D 19/00 66/174
2,942,442 A * 6/1960 Michael-Lohs ..... A41D 19/01511 15/227

(Continued)

FOREIGN PATENT DOCUMENTS

CN 1484502 3/2004
CN 101155953 4/2008

(Continued)

OTHER PUBLICATIONS

EP Office Action dated Dec. 10, 2018 corresponding to European Patent Application No. 13755421.8 (5 pages).

*Primary Examiner* — Danny Worrell
(74) *Attorney, Agent, or Firm* — Norris McLaughlin, P.A.

(57) ABSTRACT

A method for manufacturing a glove using a flat knitting machine, including a second pouch-like part forming step after knitting a first pouch-like part by means of a first knitting needle group. The second pouch-like part forming step includes a main body part knitting step of knitting a main body part and a pouch base part knitting step of knitting an annular pouch base part that is connected to the first pouch-like part. In the pouch base part knitting step, a first face of the annular pouch base part is knitted by a knitting needle, in the second knitting needle group, of a first row, for knitting one of the front cloth and the rear cloth, as well as a knitting needle, in the first knitting needle group, of the first row, that is adjacent to the second knitting needle group and corresponds to at least two hooks, and then a second face of the annular pouch base part is knitted by a knitting needle, in the first knitting needle group, of a second row that faces the knitting needle in the first knitting needle group that has knitted the first face of the pouch base part,
(Continued)

as well as a knitting needle, in the second knitting needle group, of the second row.

9 Claims, 8 Drawing Sheets

(58) Field of Classification Search
USPC ..... 66/174
See application file for complete search history.

(56) References Cited

U.S. PATENT DOCUMENTS 3,964,277 A * 6/1976 Miles ..... D04B 9/16 66/190
4,125,001 A * 11/1978 Bryars ..... D04B 1/04 66/190
4,172,293 A * 10/1979 Vistins ..... A41D 13/04 156/280
RE30,638 E * 6/1981 Bryars ..... D04B 1/12 66/191
4,470,251 A * 9/1984 Bettcher ..... A41D 19/01511 2/16
5,070,540 A * 12/1991 Bettcher ..... A41D 19/0058 156/165
5,745,919 A * 5/1998 Kraatz ..... D02G 3/442 2/159
5,822,791 A * 10/1998 Baris ..... A41D 19/0065 112/16
6,155,084 A * 12/2000 Andrews ..... A41D 13/08 2/16
6,161,400 A * 12/2000 Hummel ..... A41D 19/01505 2/16
6,823,699 B1 * 11/2004 Vero ..... A41D 19/01505 2/161.6
6,915,667 B2 * 7/2005 Morita ..... D04B 35/32 66/120
6,962,064 B1 * 11/2005 Hardee ..... A41D 19/0065 2/159
7,207,194 B2 * 4/2007 Miyamoto ..... D04B 15/36 66/78
7,669,442 B1 * 3/2010 Zhu ..... A41D 19/01511 66/174
7,934,394 B2 * 5/2011 Zhu ..... A41D 19/01505 66/174
7,934,395 B2 * 5/2011 Zhu ..... A41D 19/01511 2/16
7,934,396 B2 * 5/2011 Zhu ..... A41D 19/01511 66/174
8,302,215 B2 * 11/2012 Matsunobu ..... B29C 41/14 2/161.6
2005/0076418 A1 * 4/2005 von Blucher ..... A41D 19/015 2/161.6
2007/0022511 A1 * 2/2007 Narasimhan ..... A41D 19/00 2/159
2008/0083047 A1 * 4/2008 Prickett ..... A41D 19/01505 2/16
2009/0038052 A1 * 2/2009 Gellis ..... A41D 19/01505 2/161.8
2009/0044571 A1 * 2/2009 Thompson ..... A41D 19/0096 66/174
2009/0055992 A1 * 3/2009 Thompson ..... A41D 19/0065 2/164
2009/0183296 A1 * 7/2009 Hardee ..... D02G 3/185 2/161.8
2009/0211305 A1 * 8/2009 Thompson ..... A41D 19/0065 66/174
2010/0186457 A1 * 7/2010 Zhu ..... A41D 19/01505 66/174
2010/0236294 A1 * 9/2010 Dias ..... D02G 3/12 66/174
2010/0275341 A1 * 11/2010 Sweeney ..... A41D 19/01505 2/164
2011/0162126 A1 * 7/2011 Zhang ..... D04B 1/22 2/159
2011/0209505 A1 * 9/2011 Thompson ..... A41D 19/01547 66/174
2012/0000252 A1 * 1/2012 Funaki ..... D04B 1/108 66/174
2013/0000005 A1 * 1/2013 Hughes ..... A41D 19/01505 2/16
2013/0000360 A1 * 1/2013 Ashworth ..... D04B 1/28 66/174
2013/0025327 A1 * 1/2013 Cornish ..... A41D 19/02 66/174
2013/0213094 A1 * 8/2013 Moreland ..... D04B 1/28 66/174
2013/0232662 A1 * 9/2013 Williams ..... A41D 19/001 2/164
2013/0319054 A1 * 12/2013 Asiaghi ..... G06F 3/014 66/174
2014/0005616 A1 * 1/2014 Moreland ..... A61L 15/44 604/292
2014/0026290 A1 * 1/2014 Howland ..... A41D 19/015 2/161.6
2014/0076001 A1 * 3/2014 Inagaki ..... D04B 15/36 66/65
2014/0157832 A1 * 6/2014 Thompson ..... D04B 1/28 66/174
2014/0165658 A1 * 6/2014 Cornish ..... G06F 3/03545 66/174
2014/0283559 A1 * 9/2014 Andrews ..... A41D 19/01505 66/174
2014/0290312 A1 * 10/2014 Atwood ..... A41D 19/015 66/174
2015/0181955 A1 * 7/2015 Hughes ..... A41D 19/01523 2/16
2016/0073713 A1 * 3/2016 Takata ..... A41D 19/01505 2/167

FOREIGN PATENT DOCUMENTS

CN 101310054 11/2008
CN 101324007 12/2008
CN 101435131 5/2009
CN 102333912 1/2012
EP 1 354 525 10/2003
EP 1354525 A1 * 10/2003 ..... A41D 19/00
EP 1 541 733 6/2005
EP 1541733 A1 * 6/2005 ..... D04B 1/24
EP 2401931 A2 * 1/2012 ..... A41D 19/0096
EP 3075275 A1 * 10/2016 ..... A41D 19/0006
JP 61-32420 7/1986
JP 2000-220064 8/2000
JP 2008121152 5/2008
JP 4848378 12/2011
JP 2012-012757 1/2012
WO WO-2002/052966 7/2002
WO WO-2010/128624 11/2010

* cited by examiner

METHOD FOR MANUFACTURING GLOVE, METHOD FOR MANUFACTURING COATED GLOVE, GLOVE, AND COATED GLOVE

TECHNICAL FIELD

The present invention relates to a method for manufacturing a glove, a method for manufacturing a coated glove, a glove, and a coated glove.

BACKGROUND OF THE INVENTION

Conventionally, a flat knitting machine in which a large number of knitting needles are arrayed in two rows, front and rear, in substantially parallel to each other is used for knitting a glove. Using such a flat knitting machine, a glove is generally manufactured by sequentially forming a pinky finger pouch-like part, a ring finger pouch-like part, a middle finger pouch-like part, an index finger pouch-like part, a three finger trunk pouch-like part, a four finger trunk pouch-like part, a thumb pouch-like part, and a five finger trunk pouch-like part.

In manufacture of such a glove, a holding bar called "stitch holder" is employed for preventing formation of a hole in a between-finger part between the pouch-like parts. More specifically, after knitting the pouch-like part for a ring finger, a stitch on a middle finger side among stitches of this pouch-like part for a ring finger is retained by the holding bar. The pouch-like part for a middle finger is knitted by a knitting needle in a state of being inserted into the stitch thus retained by the holding bar as well as a knitting needle which is adjacent to this knitting needle on a middle finger side, and then the pouch-like part for an index finger is knitted in a similar way. Thereafter, by releasing the retention by the holding bar upon formation of the three-finger trunk, the ring finger pouch-like part, the middle finger pouch-like part, and the index finger pouch-like part are connected.

However, manufacture employing the holding bar has the following problems.

(1) Adjustment of the holding bar is difficult and complex. Moreover, failure in operation of the holding bar leads to manufacture of defective gloves and a decrease in manufacturing efficiency.

(2) Fabrication of the holding bar itself is difficult. Moreover, the holding bar being an expendable part leads to an increase in manufacturing cost.

(3) In manufacture of a high-gauge glove that requires use of a fine yarn, likelihood of breakage of the yarn due to friction with the holding bar is increased.

(4) In a glove having a structure knitted by using the holding bar, flexibility in the between-finger part is low. In manufacture of a coated glove by forming a coating layer onto a glove being fitted on a model hand, this may lead to defective coating in the between-finger part due to poor fit to the model hand.

In addition, a method disclosed in Japanese Examined Patent Application Publication No. S61-32420 is publicly known as a glove knitting method. In this publication, a method using no holding bar in knitting of a between-finger part between a three-finger trunk pouch-like part and the pinky finger pouch-like part is disclosed. Specifically, the method disclosed in the publication is a method in which: after knitting the pinky finger pouch-like part, the three-finger trunk pouch-like part is knitted by a knitting needle which is different from a knitting needle having knitted the pinky finger pouch-like part; in a first one of last two round courses for the three-finger trunk pouch-like part, knitting is performed by using a knitting needle for knitting the three-finger trunk pouch-like part as well as a knitting needle, among the knitting needles having knitted the pinky finger pouch-like part, on the three-finger trunk pouch-like part side and on a front side; and in a second one of the two round courses (last round course), knitting is performed by using a knitting needle for knitting the three-finger trunk pouch-like part as well as a knitting needle, among the knitting needles having knitted the pinky finger pouch-like part, on the three-finger trunk pouch-like part side and on a rear side. Furthermore, the method disclosed in the publication is a method in which tuck stitch is performed for the between-finger part in a first round course in knitting of a four finger trunk pouch-like part, which is knitted after knitting of the three-finger trunk pouch-like part.

However, in the method disclosed in the above identified publication, the first and second ones of the last two round courses for the three-finger pouch-like part are respectively connected to the pinky finger pouch-like part only in either of a front cloth and a rear cloth, easily forming a hole in the between-finger part. In other words, for example in the first round course (a former round course), the three-finger pouch-like part and the pinky finger pouch-like part are connected to each other only with one stitch in the front cloth of the pinky finger pouch-like part, still easily forming a hole in the front cloth. Similarly, in the second round course (a latter round course), the three-finger pouch-like part and the pinky finger pouch-like part are connected to each other only with one stitch in the front cloth of the pinky finger pouch-like part, also easily forming a hole in the front cloth. As discussed above, in the first and second ones of the last two round courses, holes are easily formed in the front cloth and rear cloth respectively, a hole is formed more easily in a synergistic manner in the between-finger part, thus hindering effective prevention of formation of a hole in the between-finger part.

In addition, in the method disclosed in the above identified publication, tuck stitch is performed for the between-finger part in the first round course in knitting of the four finger trunk pouch-like part; however, the tucked part becomes double layered and lacks stretchability and flexibility. As a result, in a case in which such a glove is used for manufacture of a coated glove, defective coating is likely in the between-finger part due to poor fit of the glove to the model hand.

Furthermore, the above identified publication also discloses another embodiment of last round courses for the three finger trunk. In the another embodiment, in the last three round courses for the three finger trunk, the above described first and second round courses (connecting only one stitch on front and rear sides respectively) take place in the former two round courses, and then, in the last round course, knitting is performed using, along with a knitting needle for knitting the three-finger trunk pouch-like part, a knitting needle which was used in the first and second round courses, among knitting needles having knitted the pinky finger pouch-like part. In other words, in the last round course, one stitch is provided respectively on the front cloth and the rear cloth in the pinky finger pouch-like part.

In such a method employing the last three round courses, since the three-finger trunk pouch-like part and the pinky finger pouch-like part are connected to each other both on the front cloth and the rear cloth in the last round course, formation of a hole is less likely compared to the first and second round courses; however, the connection is made only by a stitch on front and rear sides in the pinky finger pouch-like part in the last round course. As a result, in a case in which the yarn is slack, a hole is formed in the between-finger part. Especially in a case of a high gauge glove using a fine yarn, only one stitch on the front and rear sides is not sufficient for fully connecting the three-finger trunk pouch-like part to the pinky finger pouch-like part, resulting in easy formation of a hole in the between-finger part.

In addition, in the above described method employing the last three round courses, since the same plurality of knitting needles (knitting needles for the three-finger trunk pouch-like part and the pinky finger pouch-like part, on front and rear sides, in areas adjacent to each other) is controlled and used for performing different round courses, a structure of stitches becomes complex to tend to give an uncomfortable sensation to a wearer. Furthermore, in a case in which a force is applied in a direction of stretching the between-finger part, the force is not distributed uniformly due to the complex structure and tends to concentrate on a yarn in a specific one of round courses, thus pulling the yarn in such a part and hindering effective prevention of formation of a hole in the between-finger part.

Moreover, as described above, in the method employing the last three round courses, control is required for performing three different round courses, making the control method complex. Especially in a conventionally known flat knitting machine, knitting needles used for each round course is generally selected by a control by a needle selection drum; however, in a case of performing the last three round courses in each of the between-finger parts as described above, there will be too many selection patterns of knitting needles to process by a general needle selection drum, and remodeling of the needle selection drum and the like is required.

PRIOR ART DOCUMENTS

Patent Document 1: Japanese Examined Patent Application Publication No. S61-32420

SUMMARY OF THE INVENTION

The present invention has been made in view of the above described inconveniences. A first problem to be solved by the present invention is to provide a method for manufacturing a glove that allows easy manufacture of a glove that does not easily form a hole in the between-finger part. In addition, a second problem to be solved by the present invention is to provide a method for manufacturing a coated glove that does not cause defective coating in the between-finger part. Furthermore, a third problem to be solved by the present invention is to provide a glove that is easy to manufacture and does not easily form a hole in the between-finger part. A fourth problem to be solved by the present invention is to provide a coated glove that is easy to manufacture and has superior coating in the between-finger part.

A method for manufacturing a glove according to the present invention that has been made to solve the above-mentioned first problem is characterized by a method for manufacturing a glove, the glove being provided with a front cloth and a rear cloth composing a plurality of pouch-like parts covering hand fingers and having: an annular pouch base part in which a second pouch-like part which is adjacent to first pouch-like part connects to the first pouch-like part; and a cylindrical main body part that connects to a front end side thereof, by using a flat knitting machine in which a large number of knitting needles with a hook that are arranged in two rows in a state in which hook sides thereof face each other, wherein the large number of knitting needles are sectioned into a first knitting needle group that knits the first pouch-like part and a second knitting needle group that knits the second pouch-like part, the method comprising: a first pouch-like part forming step of knitting the first pouch-like part; and a second pouch-like part forming step of knitting the second pouch-like part after the first pouch-like part forming step, wherein: the second pouch-like part forming step includes a main body part knitting step of knitting the main body part and a pouch base part knitting step of knitting the pouch base part; and in the pouch base part knitting step, a first face of the annular pouch base part is knitted by a knitting needle, in the second knitting needle group, of a first row, for knitting one of the front cloth and the rear cloth, as well as a knitting needle, in the first, knitting needle group, of the first row, that is adjacent to the second knitting needle group and corresponds to at least two hooks, and then a second face of the annular pouch base part is knitted by a knitting needle, in the first knitting needle group, of a second row that faces the knitting needle in the first knitting needle group that has knitted the first face of the pouch base part, as well as a knitting needle, in the second knitting needle group, of the second row.

In a glove manufactured by the method for manufacturing a glove, an annular pouch base part is provided consecutively from the main body part of the second pouch-like part toward a wrist, the annular pouch base part connecting the first pouch-like part to the second pouch-like part. In addition, the pouch base part is woven into two stitches respectively on the front and rear sides (four stitches in total of front and rear), among stitches in the first pouch-like part, that are adjacent to the second pouch-like part side. More specifically, the pouch base part includes: a front face portion that is provided consecutively from the front cloth in the main body part of the second pouch-like part; a pouch-like part connecting front side portion that is continued from the front face portion in the same course and is provided consecutively from the front cloth of at least two stitches, among the stitches of the first pouch-like part, on the second pouch-like part side toward a wrist; a pouch-like part connecting rear side portion that is continued from the pouch-like part connecting front side portion in the same course and is provided consecutively from the rear cloth of at least two stitches, among the stitches of the first pouch-like part, on the second pouch-like part side toward a wrist, and a rear face portion that is continued from the pouch-like part connecting front side portion in the same course and is provided consecutively from the rear cloth of the main body part of the second pouch-like part toward a wrist.

In the glove, since the pouch base part of the second pouch-like part has the front cloth (the front face portion and the pouch-like part connecting front side portion) and the rear cloth (the rear face portion and the pouch-like part connecting rear side portion) as described above, the first pouch-like part and the second pouch-like part can be infallibly connected to each other both on the front and rear sides, thus effectively preventing formation of a hole in the between-finger part. In addition, since the pouch-like part connecting front side portion and the pouch-like part connecting rear side portion are woven into at least two stitches in the first pouch-like part, the first pouch-like part and the second pouch-like part can be connected to each other more infallibly, thus preventing formation of a hole in the between-finger part more effectively.

In addition, the method for manufacturing a glove allows easier and more infallible manufacture of a glove compared to a conventional manufacturing method employing a holding bar. Furthermore, the method for manufacturing a glove allows easier control of knitting needles compared to a conventional method of knitting the last three round courses in different patterns, and easier and more infallible manufacture using a generally used flat knitting machine. Particularly, in a glove manufactured by the present manufacturing method, the between-finger part has a simpler structure which does not tend to give an uncomfortable sensation to a wearer, and a force applied to the between-finger part is more easily distributed uniformly, not easily forming a hole, compared to a glove manufactured with the conventional last three round courses in different patterns.

It is preferable that the method for manufacturing a glove further includes, at least after the main body knitting step in the second pouch-like part forming step, a front and rear cloth connecting step of knitting a first front and rear cloth connecting part that connects the front cloth and the rear cloth in the first pouch-like part and/or the second pouch-like part by means of at least an anteroposterior pair of knitting needles, in the first knitting needle group, that is adjacent to the second knitting needle group and/or at least an anteroposterior pair of knitting needles, in the second knitting needle group, that is adjacent to the first knitting needle group. According to the manufacturing method thus configured, a glove can be manufactured in which the pouch base part is provided with the first front and rear cloth connecting part that connects the front cloth and the rear cloth. In the glove thus manufactured, formation of a hole in the pouch base part is less likely since the front cloth and the rear cloth are connected by the first front and rear cloth connecting part.

It is preferable that a knitting needle in the first knitting needle group that knits a pouch base part in the pouch base part knitting step in the second pouch-like part forming step, and a knitting needle that is adjacent thereto are used as knitting needles for knitting the front and rear cloth connecting part in the front and rear cloth connecting step. As a result, the front and rear cloth connecting part is provided in a wale direction of the pouch-like part connecting front side portion and the pouch-like part connecting rear side portion, the front and rear cloth connecting part thus hindering an anteroposterior stretching force from being applied to the pouch-like part connecting front side portion and the pouch-like part connecting rear side portion and allowing the front and rear cloth connecting part to prevent formation of a hole in the pouch base part effectively.

Although the front and rear cloth connecting step can take place before the pouch base part knitting step in the second pouch-like part forming step; it is more preferable to perform the step after the pouch base part knitting step. In a case of performing the front and rear cloth connecting step before the pouch base part knitting step, the front and rear cloth connecting part is exposed to an outer face side in the between-finger part. On the contrary, in a case of performing the front and rear cloth connecting step after the pouch base part knitting step as described above, the front and rear cloth connecting part is positioned more on an inner face side than a portion connecting the pouch-like parts. Given this, when a force in a direction of separating the front cloth and the rear cloth is applied to a wrist side of the between-finger part (for example, when a wearer is putting the glove on), the force in a direction of separating the front cloth and the rear cloth tends to be applied to the front and rear cloth connecting part positioned more on the inner face side than the pouch base part, thus hindering a force stretching the pouch-like part connecting front side portion and the pouch-like part connecting rear side portion in an anteroposterior direction from being applied and allowing more effective prevention of formation of a hole in the between-finger part.

In addition, in a case of performing the front and rear cloth connecting step after the pouch base part knitting step as described above, it is preferable to knit the second front and rear cloth connecting part of the between-finger parts between other pairs of pouch-like parts, by the front and rear cloth connecting step in the same course. In other words, is preferable that a third knitting needle group that is a plurality of knitting needles for knitting a third pouch-like part and adjacent to the second knitting needle group on an opposite side to the first knitting needle group is sectioned, the method comprising a third pouch-like part forming step of knitting the third pouch-like part by means of the third knitting needle group, wherein: the third pouch-like part forming step includes a main body part knitting step of knitting a main body part of the third pouch-like part by means of the third knitting needle group and a pouch base part knitting step of knitting an annular pouch base part that is provided consecutively from the main body part of the third pouch-like part toward a wrist and connects the second pouch-like part and the third pouch-like part; and the front and rear cloth connecting step knits the first front and rear cloth connecting part and a second front and rear cloth connecting part in the same course. It should be noted that, as used herein, the "second front and rear cloth connecting part" indicates a part where the front cloth and the rear cloth in the second pouch-like part and/or the third pouch-like part are connected to each other in the between-finger part between the second pouch-like part and the third pouch-like part. By employing the above described configuration, a plurality of front and rear cloth connecting parts can be formed in the same course, allowing easy control of knitting needles and easy and infallible manufacture using a generally used flat knitting machine. In addition, since a plurality of front and rear cloth connecting parts can be formed in the same course, manufacturing time can be reduced.

In addition, a method for manufacturing a glove according to the present invention that has been made to solve the abovementioned first problem is characterized by a method for manufacturing a glove, the glove being provided with a front cloth and a rear cloth composing a plurality of pouch-like parts covering hand fingers and having:

an annular pouch base part in which a middle finger pouch-like part which is adjacent to a ring finger pouch-like part connects to the ring finger pouch-like part and a cylindrical main body part that connects to a front end side thereof;

an annular pouch base part in which an index finger pouch-like part which is adjacent to the middle finger pouch-like part connects to the middle finger pouch-like part and a cylindrical main body part that connects to a front end side thereof;

an annular pouch base part in which a three finger trunk pouch-like part which is adjacent to a pinky finger pouch-like part connects to the pinky finger pouch-like part and a cylindrical main body part that connects to a front end side thereof; and an annular pouch base part in which a thumb pouch-like part which is adjacent to a four finger trunk pouch-like part connects to the four finger trunk pouch-like part and a cylindrical main body part that connects to a front end side thereof, by using a flat knitting machine in which a large number of knitting needles with a hook that are arranged in two rows in a state in which hook sides thereof face each other, wherein the large number of knitting needles are sectioned into a thumb knitting needle group that knits the thumb pouch-like part, an index finger knitting needle group that knits the index finger pouch-like part, a middle finger knitting needle group that knits the middle finger pouch-like part, a ring finger knitting needle group that knits the ring finger pouch-like part, and a pinky finger knitting needle group that knits the pinky finger pouch-like part, the method comprising:

a pinky finger pouch-like part forming step of knitting the pinky finger pouch-like part;

a ring finger pouch-like part forming step of knitting the ring finger pouch-like part;

a middle finger pouch-like part forming step of knitting the middle finger pouch-like part after the ring finger pouch-like part forming step;

an index finger pouch-like part forming step of knitting the index finger pouch-like part after the middle finger pouch-like part forming step;

a three finger trunk pouch-like part forming step of knitting the three finger trunk pouch-like part that is consecutively provided from the index finger pouch-like part, the middle finger pouch-like part, and the ring finger pouch-like part toward a wrist, by means of a three finger trunk knitting needle group including the index finger knitting needle group, the middle finger knitting needle group, and the ring finger knitting needle group after the index finger pouch-like part forming step;

a four finger trunk pouch-like part forming step of knitting the four finger trunk pouch-like part that is consecutively provided from the three finger trunk pouch-like part and the pinky finger pouch-like part toward a wrist, by means of a four finger trunk knitting needle group including the index finger knitting needle group, the middle finger knitting needle group, the ring finger knitting needle group, and the pinky finger knitting needle group after the pinky finger pouch-like part forming step and the three finger trunk pouch-like part forming step;

a thumb pouch-like part forming step of knitting the thumb pouch-like part after the four finger trunk pouch-like part forming step; and a five finger trunk pouch-like part forming step of knitting a pouch-like five finger trunk pouch-like part that is provided consecutively from the four finger trunk pouch-like part and the thumb pouch-like part toward a wrist, by means of the thumb knitting needle group and the four finger trunk knitting needle group after the thumb pouch-like part forming step, wherein:

the middle finger pouch-like part forming step includes a main body part knitting step of knitting a main body part of the middle finger pouch-like part and a pouch base part knitting step of knitting a pouch base part of the middle finger pouch-like part;

in the pouch base part knitting step in the middle finger pouch-like part forming step, a first face of the annular pouch base part is knitted by means of a knitting needle, in the middle finger knitting needle group, of a first row that knits one of the front cloth and the rear cloth, as well as a knitting needle, in the ring finger knitting needle group, of the first row, that is adjacent to the middle finger knitting needle group and corresponds to at least two hooks;

then, a second face of the annular pouch base part is knitted by means of a knitting needle, in the ring finger knitting needle group, of a second row that faces the knitting needle in the ring finger knitting needle group that has knitted the first face of the pouch base part, as well as a knitting needle of the second row in the middle finger knitting needle group;

the index finger pouch-like part forming step includes a main body part knitting step of knitting a main body part of the index finger pouch-like part and a pouch base part knitting step of knitting a pouch base part of the index finger pouch-like part;

in the pouch base part knitting step in the index finger pouch-like part forming step, a first face of the annular pouch base part is knitted by means of a knitting needle, in the index finger knitting needle group, of a first row that knits one of the front cloth and the rear cloth, as well as a knitting needle, in the middle finger knitting needle group, of the first row, that is adjacent to the index finger knitting needle group and corresponds to at least two hooks;

then, a second face of the pouch base part is knitted by means of a knitting needle, in the middle finger knitting needle group, of a second row that faces the knitting needle in the middle finger knitting needle group that has knitted the first face of the pouch base part, as well as a knitting needle of the second row in the index finger knitting needle group;

the three finger trunk pouch-like part forming step includes a main body part knitting step of knitting a main body part of the three finger trunk pouch-like part and a pouch base part knitting step of knitting a pouch base part of the three finger trunk pouch-like part;

in the pouch base part knitting step in the three finger trunk pouch-like part forming step, a first face of the annular pouch base part is knitted by means of a knitting needle, in the three finger trunk knitting needle group, of a first row that knits one of the front cloth and the rear cloth, as well as a knitting needle, in the pinky finger knitting needle group, of the first row, that is adjacent to the ring finger knitting needle group and corresponds to at least two hooks;

then, a second face of the annular pouch base part is knitted by means of a knitting needle, in the pinky finger knitting needle group, of a second row that faces the knitting needle in the pinky finger knitting needle group that has knitted the first face of the pouch base part, as well as a knitting needle of the second row in the three finger trunk knitting needle group;

the thumb pouch-like part forming step includes a main body part knitting step of knitting a main body part of the thumb pouch-like part and a pouch base part knitting step of knitting a pouch base part of the thumb pouch-like part;

in the pouch base part knitting step in the thumb pouch-like part forming step, a first face of the annular pouch base part is knitted by means of a knitting needle, in the thumb knitting needle group, of a first row that knits one of the front cloth and the rear cloth, as well as a knitting needle which is adjacent to said knitting needle, in the index finger knitting needle group, of the first row, that is adjacent to the thumb knitting needle group and corresponds to at least two hooks;

then, a second face of the annular pouch base part is knitted by means of a knitting needle, in the index finger knitting needle group, of a second row that faces the knitting needle in the index finger knitting needle group that has knitted the first face of the pouch base part, as well as a knitting needle of the second row in the thumb knitting needle group.

In the glove manufactured by the present method for manufacturing a glove, the annular pouch base part is provided consecutively from respective main body parts of the middle finger pouch-like part, the index finger pouch-like part, the three finger trunk pouch-like part, and the thumb pouch-like part toward a wrist, and a glove in which adjacent pouch-like parts are connected to each other by way of the annular pouch base parts can thus be manufactured. In addition, the pouch base parts of the glove are woven into two stitches respectively on the front and rear sides (four stitches in total of front and rear), among stitches in adjacent pouch-like parts. The pouch-like parts can thus be infallibly connected to each other in both the front cloth and the rear cloth of the pouch base part, effectively preventing formation of a hole in the between-finger part. Furthermore, since the front cloth and the rear cloth of the pouch base part are woven respectively into at least two stitches in the adjacent pouch-like part, the pouch-like parts can be connected to each other more infallibly and formation of a hole in the between-finger part can be prevented more effectively. Moreover, the present method for manufacturing a glove allows easier and more infallible manufacture of a glove compared to the conventional manufacturing method employing the holding bar. In addition, the present method for manufacturing a glove allows easier control of knitting needles compared to the conventional method of knitting the last three round courses in different patterns, providing easy and infallible manufacture using a generally used flat knitting machine. Particularly, the glove manufactured by the present manufacturing method has a simpler structure in the between-finger part compared to a conventional glove manufactured with the last three round courses in different patterns, and does not give an uncomfortable sensation to a wearer, while facilitating uniform distribution of a force applied to the between-finger part thus preventing formation of a hole.

A method for manufacturing a glove, the glove being provided with a front cloth and a rear cloth composing a plurality of pouch-like parts covering hand fingers and having:

art annular pouch base part in which a ring finger pouch-like part which is adjacent to a pinky finger pouch-like part connects to the pinky finger pouch-like part and a cylindrical main body part that connects to a front end side thereof;

an annular pouch base part in which a middle finger pouch-like part which is adjacent to the ring finger pouch-like part connects to the ring finger pouch-like part and a cylindrical main body part that connects to a front end side thereof;

an annular pouch base part in which an index finger pouch-like part which is adjacent to the middle finger pouch-like part connects to the middle finger pouch-like part and a cylindrical main body part that connects to a front end side thereof; and an annular pouch base part in which a thumb pouch-like part which is adjacent to a four finger trunk pouch-like part connects to the four finger trunk pouch-like part and a cylindrical main body part that connects to a front end side thereof, by using a flat knitting machine in which a large number of knitting needles with a hook that are arranged in two rows in a state in which hook sides thereof face each other, wherein the large number of knitting needles are sectioned into a thumb knitting needle group that knits the thumb pouch-like part, an index finger knitting needle group that knits the index finger pouch-like part, a middle finger knitting needle group that knits the middle finger pouch-like part, a ring finger knitting needle group that knits the ring finger pouch-like part, and a pinky finger knitting needle group that knits the pinky finger pouch-like part, the method is characterized by comprising:

a pinky finger pouch-like part forming step of knitting the pinky finger pouch-like part;

a ring finger pouch-like part forming step of knitting the ring finger pouch-like part after the pinky finger pouch-like part forming step;

a middle finger pouch-like part forming step of knitting the middle finger pouch-like part after the ring finger pouch-like part forming step;

an index finger pouch-like part forming step of knitting the index finger pouch-like part after the middle finger pouch-like part forming step;

a four finger trunk pouch-like part forming step of knitting the four finger trunk pouch-like part that is consecutively provided from the index finger pouch-like part, the middle finger pouch-like part, the ring finger pouch-like part, and the ring finger pouch-like part toward a wrist, by means of a four finger trunk knitting needle group including the index finger knitting needle group, the middle finger knitting needle group, the ring finger knitting needle group and the pinky finger knitting needle group after the index finger pouch-like part forming step;

a thumb pouch-like part forming step of knitting the thumb pouch-like part after the four finger trunk pouch-like part forming step; and a five finger trunk pouch-like part forming step of knitting a pouch-like five finger trunk pouch-like part that is provided consecutively from the four finger trunk pouch-like part and the thumb pouch-like part toward a wrist, by means of the thumb knitting needle group and the four finger trunk knitting needle group after the thumb pouch-like part forming step, wherein:

the ring finger pouch-like part forming step includes a main body part knitting step of knitting a main body part of the ring finger pouch-like part and a pouch base part knitting step of knitting a pouch base part of the ring finger pouch-like part;

in the pouch base part knitting step in the ring finger pouch-like part forming step, a first face of the annular pouch base part is knitted by means of a knitting needle, in the ring finger knitting needle group, of a first row that knits one of the front cloth and the rear cloth, as well as a knitting needle, in the pinky finger knitting needle group of the first row, that is adjacent to the ring finger knitting needle group and corresponds to at least two hooks;

then, a second face of the annular pouch base part is knitted by means of a knitting needle, in the pinky finger knitting needle group, of a second row that faces the knitting needle in the pinky finger knitting needle group that has knitted the first face of the pouch base part, as well as a knitting needle of the second row in the ring finger knitting needle group;

the middle finger pouch-like part forming step includes a main body part knitting step of knitting a main body part of the middle finger pouch-like part and a pouch base part knitting step of knitting a pouch base part of the middle finger pouch-like part;

in the pouch base part knitting step in the middle finger pouch-like part forming step, a first face of the annular pouch base part is knitted by means of a knitting needle, in the middle finger knitting needle group, of a first row that knits one of the front cloth and the rear cloth, as well as a knitting needle, in the ring finger knitting needle group of the first row, that is adjacent to the middle finger knitting needle group and corresponds to at least two hooks;

then, a second face of the annular pouch base part is knitted by means of a knitting needle, in the ring finger knitting needle group, of a second row that faces the knitting needle in the ring finger knitting needle group that has knitted the first face of the pouch base part, as well as a knitting needle of the second row in the middle finger knitting needle group;

the index finger pouch-like part forming step includes a main body part knitting step of knitting a main body part of the index finger pouch-like part and a pouch base part knitting step of knitting a pouch base part of the index finger pouch-like part;

in the pouch base part knitting step in the index finger pouch-like part forming step, a first face of the annular pouch base part is knitted by means of a knitting needle, in the index finger knitting needle group, of a first row that knits one of the front cloth and the rear cloth, as well as a knitting needle, in the middle finger knitting needle group of the first row, that is adjacent to the index finger knitting needle group and corresponds to at least two hooks;

then, a second face of the pouch base part is knitted by means of a knitting needle, in the middle finger knitting needle group, of a second row that faces the knitting needle in the middle finger knitting needle group that has knitted the first face of the pouch base part, as well as a knitting needle of the second row in the index finger knitting needle group;

the thumb pouch-like part forming step includes a main body part knitting step of knitting a main body part of the thumb pouch-like part and a pouch base part knitting step of knitting a pouch base part of the thumb pouch-like part;

in the pouch base part knitting step in the thumb pouch-like part forming step, a first face of the annular pouch base part is knitted by means of a knitting needle, in the thumb knitting needle group, of a first row that knits one of the front cloth and the rear cloth, as well as a knitting needle which is adjacent to said knitting needle, in the index finger knitting needle group of the first row, that is adjacent to the thumb knitting needle group and corresponds to at least two hooks;

then, a second face of the pouch base part is knitted by means of a knitting needle, in the index finger knitting needle group, of a second row that faces the knitting needle in the index finger knitting needle group that has knitted the first face of the pouch base part, as well as a knitting needle of the second row in the thumb knitting needle group.

In the glove manufactured by the present method for manufacturing a glove, the annular pouch base part is provided consecutively from respective main body parts of the ring finger pouch-like part, the middle finger pouch-like part, the index finger pouch-like part, and the thumb pouch-like part toward a wrist, and a glove in which adjacent pouch-like parts are connected to each other by way of the annular pouch base parts can thus be manufactured. In addition, the pouch base parts of the glove are woven into two stitches respectively on the front and rear sides (four stitches in total of front and rear), among stitches in adjacent pouch-like parts. The pooch-like parts can thus be infallibly connected to each other in both the front cloth and the rear cloth of the pouch base part, effectively preventing formation of a hole in the between-finger part. Furthermore, since the front cloth and the rear cloth of the pouch base part are woven respectively into at least two stitches in the adjacent pouch-like part, the pouch-like parts can be connected to each other more infallibly and formation of a hole in the between-finger part can be prevented more effectively. Moreover, the present method for manufacturing a glove allows easier and more infallible manufacture of a glove compared to the conventional manufacturing method employing the holding bar. In addition, the present method for manufacturing a glove allows easier control of knitting needles compared to the conventional method of knitting the last three round courses in different patterns, providing easy and infallible manufacture using a generally used flat knitting machine. Particularly, the glove manufactured by the present manufacturing method has a simpler structure in the between-finger part compared to a conventional glove manufactured with the last three round courses in different patterns, and does not give an uncomfortable sensation to a wearer, while facilitating uniform distribution of a force applied to the between-finger part thus preventing formation of a hole.

In the present method for manufacturing a glove, it is preferable that the glove is knitted with at least 1.3 gauges. This allows manufacture of a thin glove with superior fit. Furthermore, according to the present method for manufacturing a glove, the between-finger part has the above described structure and formation of a hole in the between-finger part is less likely even with the gauge of at least 13.

Furthermore, a method for manufacturing a coated glove according to the present invention that has been made to solve the abovementioned second problem includes:

the method for manufacturing a glove of the abovementioned configuration; and a coating layer forming step of forming a coating layer at least in a palm region of a glove manufactured by the method for manufacturing a glove.

In the method for manufacturing a coated glove thus configured, by manufacturing a coated glove using a glove that is resistant to formation of a hole in the between-finger part, defective coating is less likely in the between-finger part.

Moreover, a glove according to the present invention that has been made to solve the abovementioned third problem is characterized by a glove in which a pouch-like part for a trunk and a plurality of pouch-like parts for fingers that corresponds to respective fingers and is provided to protrude from the pouch-like part for a trunk are composed of a front cloth and a rear cloth that are knitted by using a flat knitting machine, wherein:

the pouch-like part includes a main body part and an annular pouch base part that is provided consecutively from the main body part toward a wrist; and the pouch base part of at least any one of the pouch-like parts includes a front face portion that is provided consecutively from the front cloth in the main body part toward a wrist, a pouch-like part connecting front side portion that is continued from the front face portion in the same course and is provided consecutively from the front cloth of at least two stitches on a second side of the pouch base part of another pouch-like part which is adjacent to a first side of the pouch-like part toward a wrist, a pouch-like part connecting rear side portion that is continued from the pouch-like part connecting front side portion in the same course and is provided consecutively from the rear cloth of at least two stitches on a second side of the pouch base part of another pouch-like part which is adjacent to a first side of the pouch-like part toward a wrist, and a rear face portion that is continued from the pouch-like part connecting front side portion in the same course and is provided consecutively from the rear cloth of the main body part toward a wrist.

In the glove, the pouch base part of at least any one of the pouch-like parts has the front face portion and the pouch-like part connecting front side portion (front cloth) as well as the rear face portion and the pouch-like part connecting rear side portion (rear cloth), thereby allowing infallible connection between the pouch-like parts both on the front and rear sides and effectively preventing formation of a hole in the between-finger part. In addition, since the pouch-like part connecting front side portion and the pouch-like part connecting rear side portion are woven into at least two stitches in respective adjacent pouch-like part, the pouch-like parts can be connected to each other more infallibly and formation of a hole in the between-finger part can be prevented more effectively. Furthermore, the glove can be manufactured more easily and more infallibly than in the conventional manufacturing method employing the holding bar. Moreover, since the control of the knitting needles can be more easily performed compared to the conventional method that knits the last three round courses in different patterns, the glove can be easily and infallibly manufactured using a generally used flat knitting machine. Especially, the glove has a simpler structure in the between-finger part compared to a glove manufactured by the conventional last three courses in different patterns and does not tend to give an uncomfortable sensation to a wearer, meanwhile a force applied to the between-finger part is distributed uniformly and does not easily form a hole.

In addition, in the glove, it is preferable that the pouch base part has a front and rear cloth connecting part that connects the front cloth and the rear cloth. Since the front cloth and the rear cloth are connected to each other by way of the front and rear cloth connecting part, this can further prevent formation of a hole in the pouch base part.

It is preferable that the front and rear cloth connecting part is provided in a wale direction of the pouch-like part connecting front side portion and the pouch-like part connecting rear side portion. As a result, the front and rear cloth connecting part hinders an anteroposterior stretching force applied to the pouch-like part connecting front side portion and the pouch-like part connecting rear side portion and the front and rear cloth connecting part can effectively prevent formation of a hole in the pouch base part.

Alternatively, a configuration in which the front and rear cloth connecting part is provided more on a fingertip side than the pouch-like part connecting front side portion and the like can be employed; however, it is preferable that the front and rear cloth connecting part is provided more on a wrist side than the front face portion, the pouch-like part connecting front side portion, the pouch-like part connecting rear side portion, and the rear face portion. In other words, in a case in which the front and rear cloth connecting part is provided more on a fingertip side than the pouch-like part connecting front side portion and the like, the front and rear cloth connecting part is exposed to the outer face side in the between-finger part. On the contrary, in a configuration in which the front and rear cloth connecting part is provided more on a wrist side than the pouch-like part connecting front side portion as described above, the front and rear cloth connecting part is positioned more on the inner face side than the pouch-like part connecting front side portion and the like. As a result, when a force in a direction of separating the front cloth and the rear cloth is applied to the wrist side of the between-finger part (for example when a wearer is putting the glove on), the force in a direction of separating the front cloth and the rear cloth tends to be directed more to the front and rear cloth connecting part than to the pouch base part and an anteroposterior separating force is not easily applied to the pouch-like part connecting front side portion and the pouch-like part connecting rear side portion, preventing formation of a hole in the between-finger part more effectively.

In addition, in a case of providing the front and rear cloth connecting part on the wrist side as described above, it is preferable that another front and rear cloth connecting part is provided in the between-finger part between other pair of pouch-like parts, in the same course as the front and rear cloth connecting part. In other words, it is preferable that the glove employs a configuration in which the pouch base parts of at least two pouch-like parts has the front face portion, the pouch-like part connecting front side portion, the pouch-like part connecting rear side portion, the rear face portion, and the front and rear cloth connecting part respectively, and the front and rear cloth connecting parts of the pouch base parts of the at least two pouch-like parts are provided in the same course. As a result, a plurality of front and rear cloth connecting parts can be formed in the same course, control of the knitting needles during manufacture can be easily performed, and the glove can be easily and infallibly manufactured using a generally used flat knitting machine. Furthermore, since a plurality of front and rear cloth connecting parts can be formed in the same course, manufacturing time of the glove can be reduced.

Moreover, it is preferable that the glove is knitted with at least 13 gauges. This can make the glove thinner and superior in fit. Since the glove has the between-finger part configured with the above described structure, a hole is not easily formed in the between-finger part even with at least 13 gauges.

In addition, a coated glove according to the present invention that has been made to solve the abovementioned fourth problem includes:

the glove of the abovementioned configuration; and a coating layer that is formed at least in a palm region of the glove.

Since the coated glove of the above described configuration is manufactured using a glove that is resistant to formation of a hole in the between-finger part, defective coating is less likely in the between-finger part.

It should be noted that, "a large number of knitting needles are arranged in two rows in a state in which hook sides thereof face each other" indicates that the knitting needles are arranged in two rows, front and rear, in a state in which hook sides thereof face each other, knitting needles on a front side being paired with respective knitting needle on a rear sides, while allowing a case in which the paired knitting needles are laterally (an array direction of the large number of knitting needles on a front side and an array direction of the large number of knitting needles on a rear side) misaligned (for example, misalignment of about a half of an interval between knitting needles which are adjacent to each other in the array direction). In addition, thumb, index finger, middle finger, ring finger and pinky finger indicate respectively anatomical first finger, second finger, third finger, fourth finger, and fifth finger.

EFFECTS OF THE INVENTION

As described above, the method for manufacturing a glove allows easy manufacture of a glove which is resistant to formation of a hole in the between-finger part. In addition, the method for manufacturing a coated glove allows easy manufacture of a coated glove that does not cause defective coating in the between-finger part. Furthermore, the glove can be easily manufactured and is resistant to formation of a hole in the between-finger part. Moreover, the coated glove can be easily manufactured and is superior in coat in the between-finger part.

DESCRIPTION OF THE PREFERRED EMBODIMENTS

Figure 1:
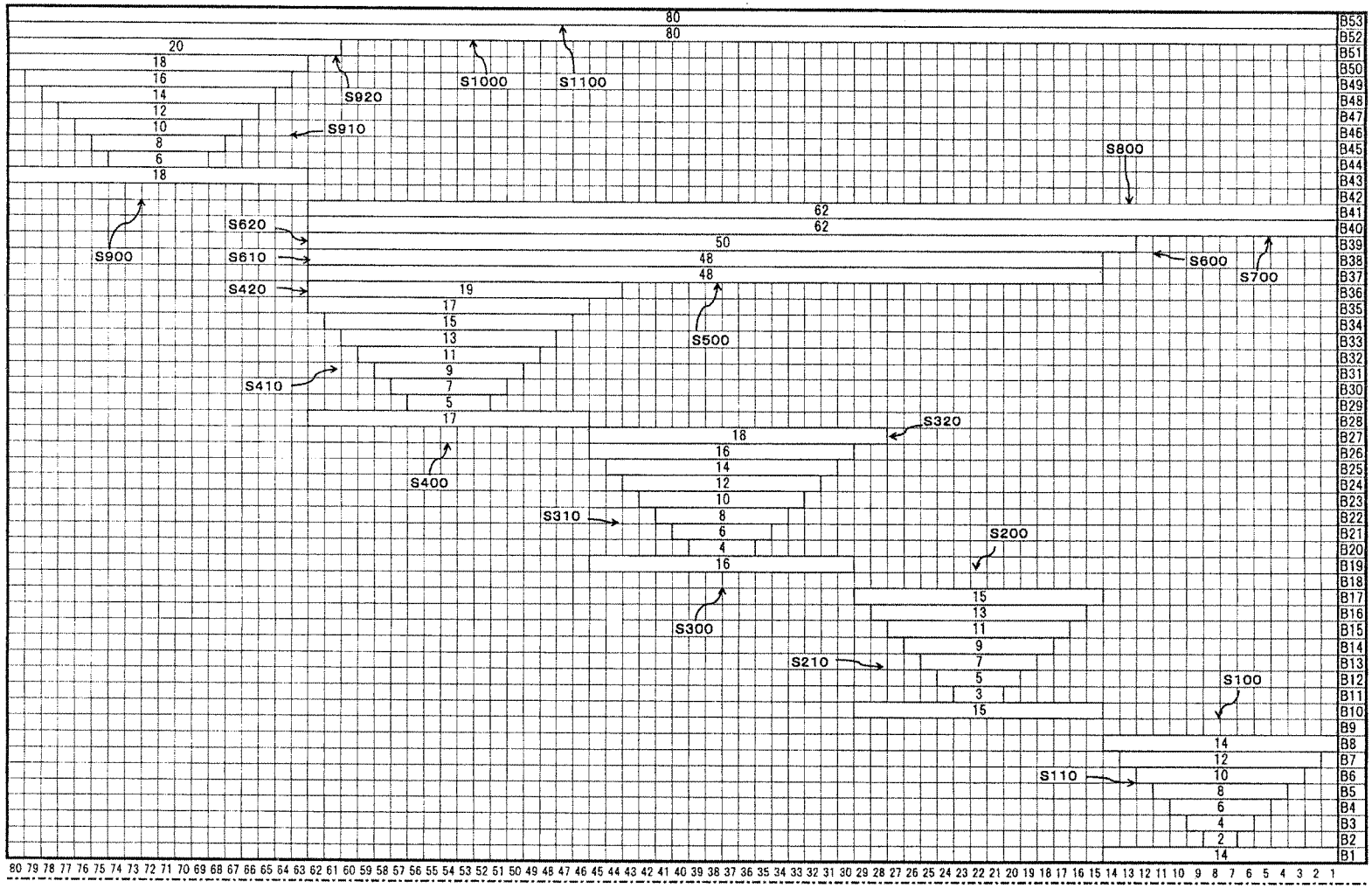
FIG. 1 is an arrangement diagram of pins of a needle selection drum, for the sake of description of a knitting needle control method of the method for manufacturing a glove according to an embodiment of the present invention, showing an arrangement of pins for controlling knitting needles on a rear side.

Embodiments of the present invention are described in detail with reference to the drawings as necessary, starting by describing a method for manufacturing a glove according to an embodiment of the present invention.

Method for Manufacturing Glove

The method for manufacturing a glove according to the present embodiment is a method of forming a glove having a front cloth and a rear cloth, using a flat knitting machine in which a large number of knitting needles are arranged in two rows, front and rear, substantially parallel, in such a way that front and rear knitting needles face each other.

Flat Knitting Machine

A conventionally known flat knitting machine can be used as the flat knitting machine. More specifically, the flat knitting machine is provided with front and rear needle beds in a pair, and a large number of knitting needles arranged substantially parallel in the needle beds, the knitting needles being disposed to be protectable and retractable through needle openings on the needle bed. In addition, the knitting needle has a hook with which a knitting yarn can be engaged. In the present embodiment, the knitting needle has a hook in a tip end part thereof. It should be noted that a knitting needle having a latch which can swing to open and close an opening of the hook can be employed.

The knitting needle has a butt which can be engaged with and released from a cam mechanism, and is configured to be projected and retracted through the needle opening as the butt engages with the cam mechanism. In addition, each knitting needle is disposed to be swingable in the needle bed so as to make the butt engaged and released with respect to the cam mechanism.

Furthermore, the flat knitting machine has a control means which controls the knitting needles being projected and retracted through the needle opening. The control means controls: a swing state of the knitting needle; engagement between the butt being provided to project from the knitting needle and the cam mechanism; and projection and retraction of the knitting needle through the needle opening in accordance with a knitting method of each course.

More specifically, the control means is composed of a needle selection drum consisting of: a rotating body having a plurality of grooves along an axial direction on an outer periphery thereof and pins detachably attached to the rotating body. The rotating body is provided to rotate in a circumferential direction according to a pitch of the grooves. The pins have a length in an axial direction corresponding to the arrangement interval of the knitting needles, and are provided to be able to contact respective knitting needles according to a rotation angle of the rotating body. The needle selection drum is designed to swing the knitting needle so as to release the butt from the cam mechanism when the knitting needle contacts the pin, and to swing the knitting needle so as to engage the butt with the cam mechanism when the knitting needle contacts the rotating body without contacting the pin. As a result, desired knitting is realized by attaching the pins to the rotating body according to a knitting method of each course, and the knitting needles to be projected and retracted can be selected as represented by F1 to F53 as well as B1 to B53 in FIGS. 1 and 2 by controlling the rotation angle of the rotating body. It should be noted that, in the present embodiment, since a knitting needle contacts a pin in the rotating body and the knitting needle has a hook, a pin in the rotating body corresponds to a stitch in a glove.

Gauge

In the present method for manufacturing a glove, knitting is performed with 26 gauge. It should be noted that the gauge is preferably at least 13 gauge, more preferably at least 20 gauge, and particularly preferably at least 26 gauge. The gauge lower than the above described lower limit may make the resulting glove too heavyweight and poor in fit.

A yarn used in the present method for manufacturing a glove is a yarn composed of wooly nylon and the like. It should be noted that the yarn is not limited to wooly nylon and various types of yarn can be used. For example, the yarn can be composed of polyester and the like. In addition, the yarn of a thickness of at least 11 dtex and no greater than 385 dtex is preferably used, and the yarn of a thickness of at least 33 dtex and no greater than 308 dtex is more preferably used. The thickness of the yarn smaller than the above described lower limit makes handling difficult and may increase the manufacturing cost; and the thickness of the yarn greater than the above described upper limit make the yarn too thick and may hinder knitting with desired gauge.

Sectioning of Knitting Needle Groups

In the present method for manufacturing a glove, a plurality of knitting needles form knitting needle groups, and the knitting needle groups are sectioned as a plurality of knitting needle groups. In other words, the plurality of knitting needle groups are sectioned at least as: a first knitting needle group which is a plurality of knitting needles for knitting a first pouch-like part; a second knitting needle group which is a plurality of knitting needles, adjacent to the first knitting needle group, for knitting a second pouch-like part; and a third knitting needle group, which is a plurality of knitting needles, adjacent to the second knitting needle group (on an opposite side to the first knitting needle group), for knitting a third pouch-like part.

More specifically, a thumb knitting needle group which is a plurality of knitting needles (63 to 80 in FIGS. 1 and 2) for knitting a thumb pouch-like part; an index finger knitting needle group which is a plurality of knitting needles (46 to 62 in the same figures), adjacent to the thumb knitting needle group, for knitting an index finger pouch-like part; a middle finger knitting needle group which is a plurality of knitting needles (30 to 45 in the same figures), adjacent to the index finger knitting needle group, for knitting a middle finger pouch-like part; a ring finger knitting needle group which is a plurality of knitting needles (15 to 29 in the same figures), adjacent to the middle finger knitting needle group, for knitting a ring finger pouch-like part; and a pinky finger knitting needle group which is a plurality of knitting needles (1 to 14 in the same figures), adjacent to the ring finger knitting needle group, for knitting a pinky finger pouch-like part are sectioned.

It should be noted that, in the present embodiment, the ring finger pouch-like part, the middle finger pouch-like part, and the index finger pouch-like part are exemplified as the first pouch-like part, the second pouch-like part, and the third pouch-like part respectively, for the description given hereafter.

Overall Configuration

In the method for manufacturing a glove of the present embodiment, the pinky finger pouch-like part, the ring finger pouch-like part, the middle finger pouch-like part, the index finger pouch-like part, the three finger trunk pouch-like part, the four finger trunk pouch-like part, the thumb pouch-like part, and the five finger trunk pouch-like part are knitted sequentially, by sequentially performing a pinky finger pouch-like part forming step S100, a ring finger pouch-like part, forming step S200, a middle finger pouch-like part forming step S300, an index finger pouch-like part forming step S400, a front and rear cloth connecting step S500, a three finger trunk pouch-like part forming step S600, a front and rear cloth connecting step S700, a four finger trunk pouch-like part forming step S300, a thumb pouch-like part forming step S900, a front and rear cloth connecting step S1000, and a five finger trunk pouch-like part forming step S1100, which are described in detail hereafter.

Pouch-Like Part Forming Step

Figure 2:
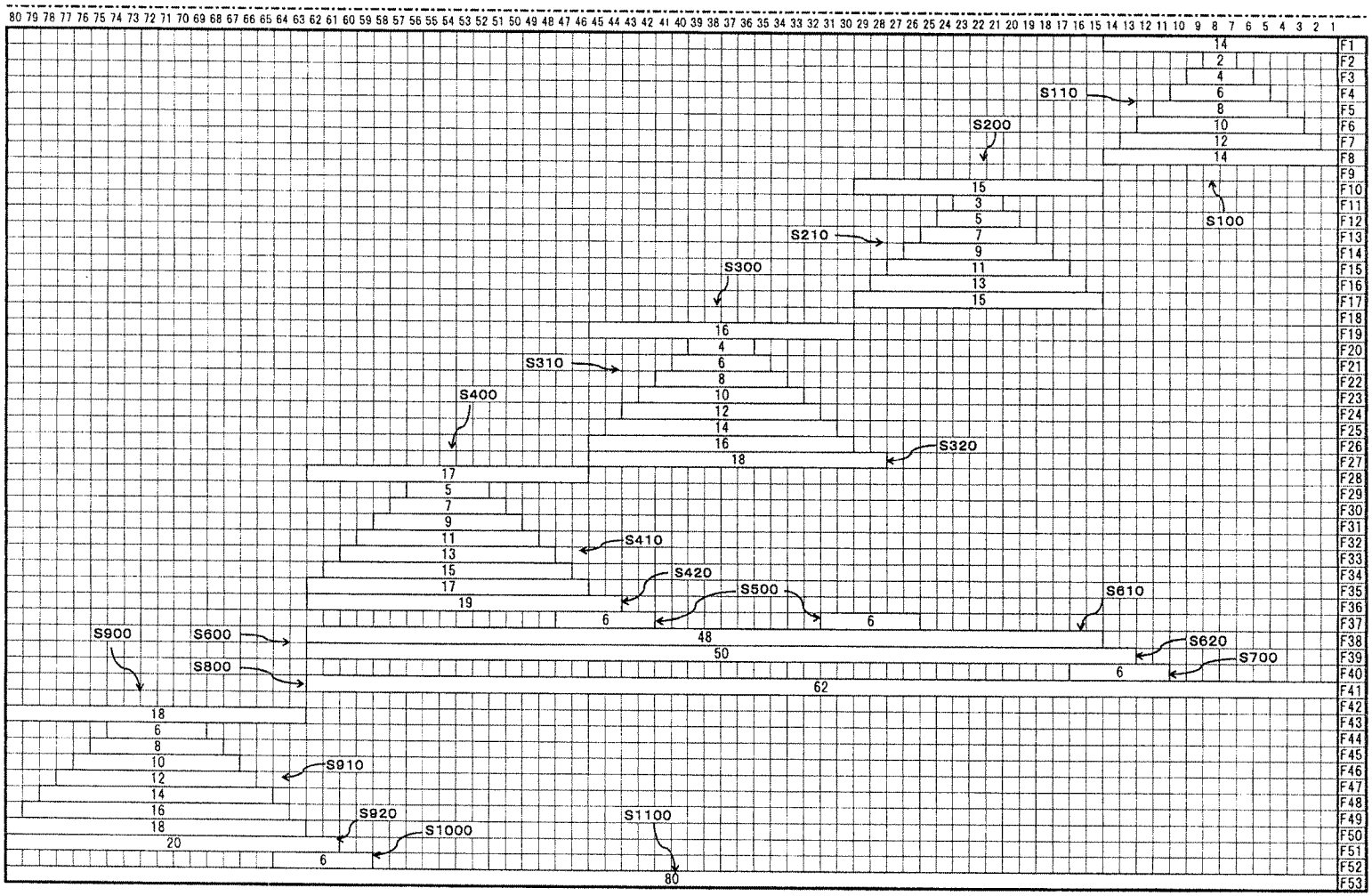
FIG. 2 is an arrangement diagram of pins of a needle selection drum, for the sake of explanation of a knitting needle control method of the method for manufacturing a glove according to an embodiment of the present invention, showing an arrangement of pins for controlling knitting needles on a front side.
Figure 3:
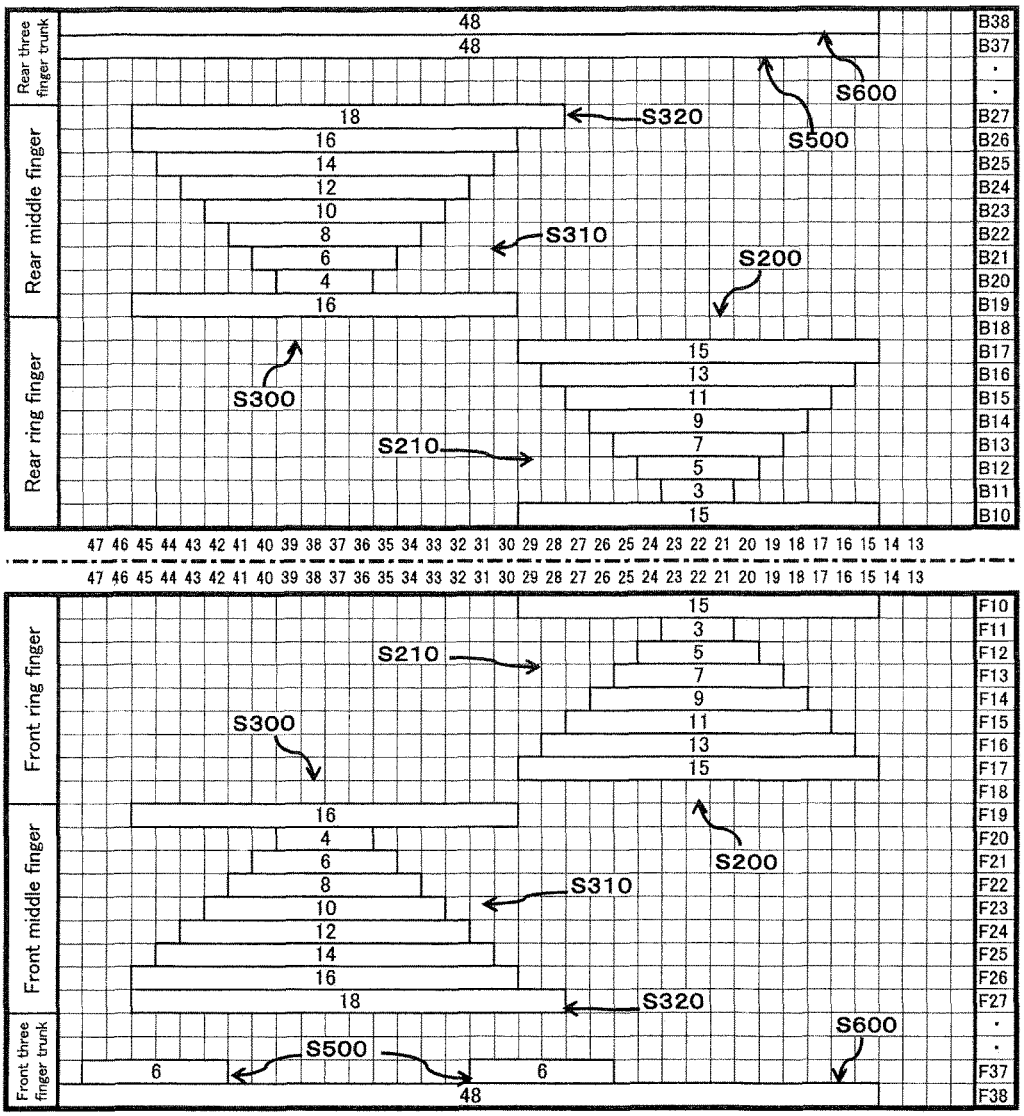
FIG. 3 is an arrangement diagram of pins of a needle selection drum, for the sake of explanation of a knitting needle control method of the method for manufacturing a glove according to an embodiment of the present invention, extracting a main part.
Figure 4:
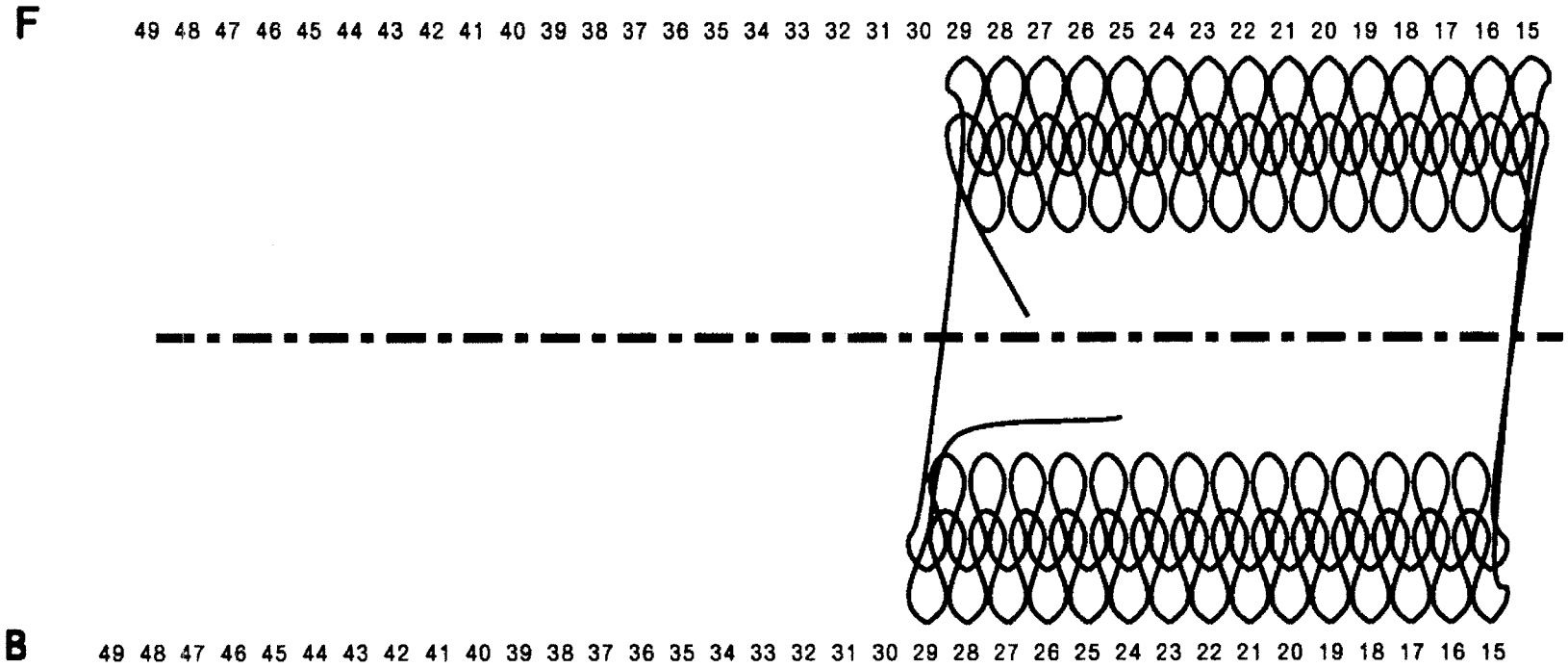
FIG. 4 is a schematic explanatory diagram for the sake of explanation of a stitch structure in a between-finger part in the method for manufacturing a glove according to the same embodiment, showing a state in which a ring finger pouch-like part has been knitted.
Figure 5:
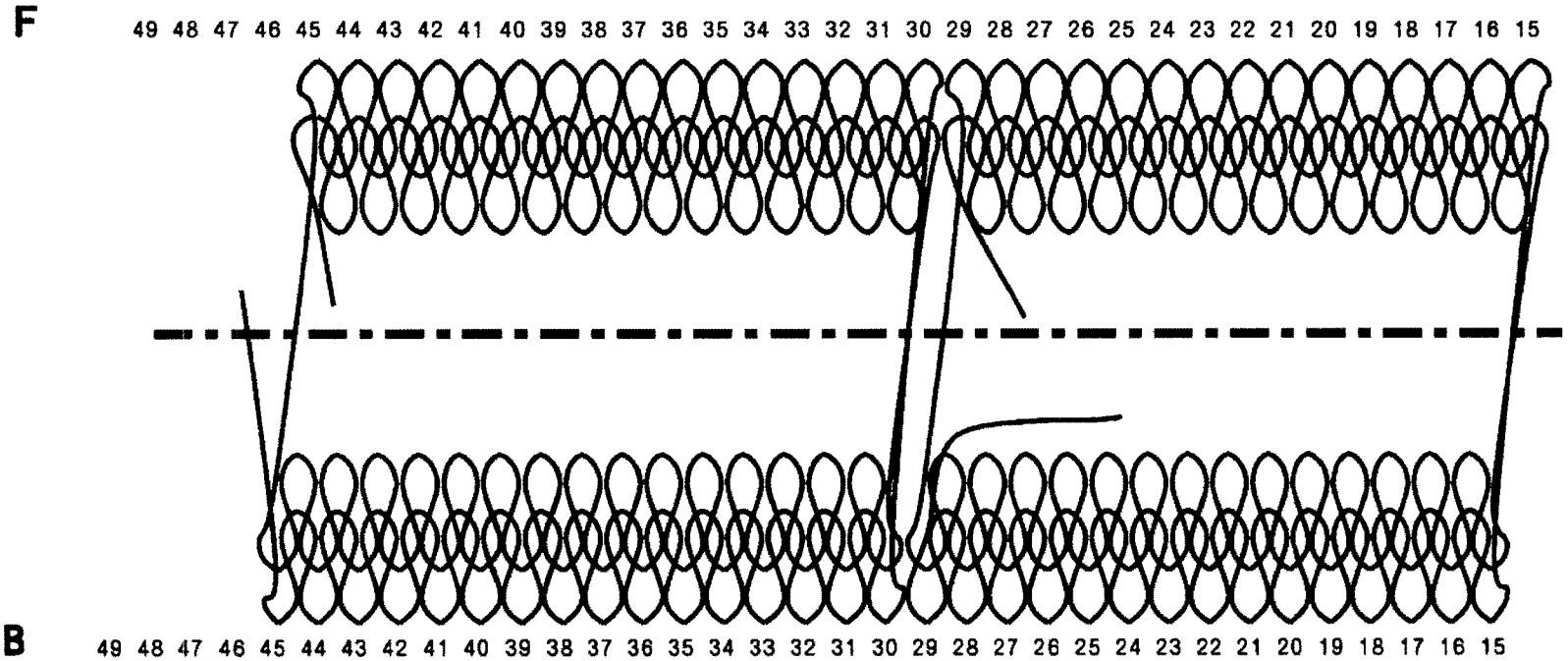
FIG. 5 is a schematic explanatory diagram for the sake of explanation of a stitch structure in a between-finger part in the method for manufacturing a glove according to the same embodiment, showing a state in which a main part of a middle finger pouch-like part has been knitted.
Figure 6:
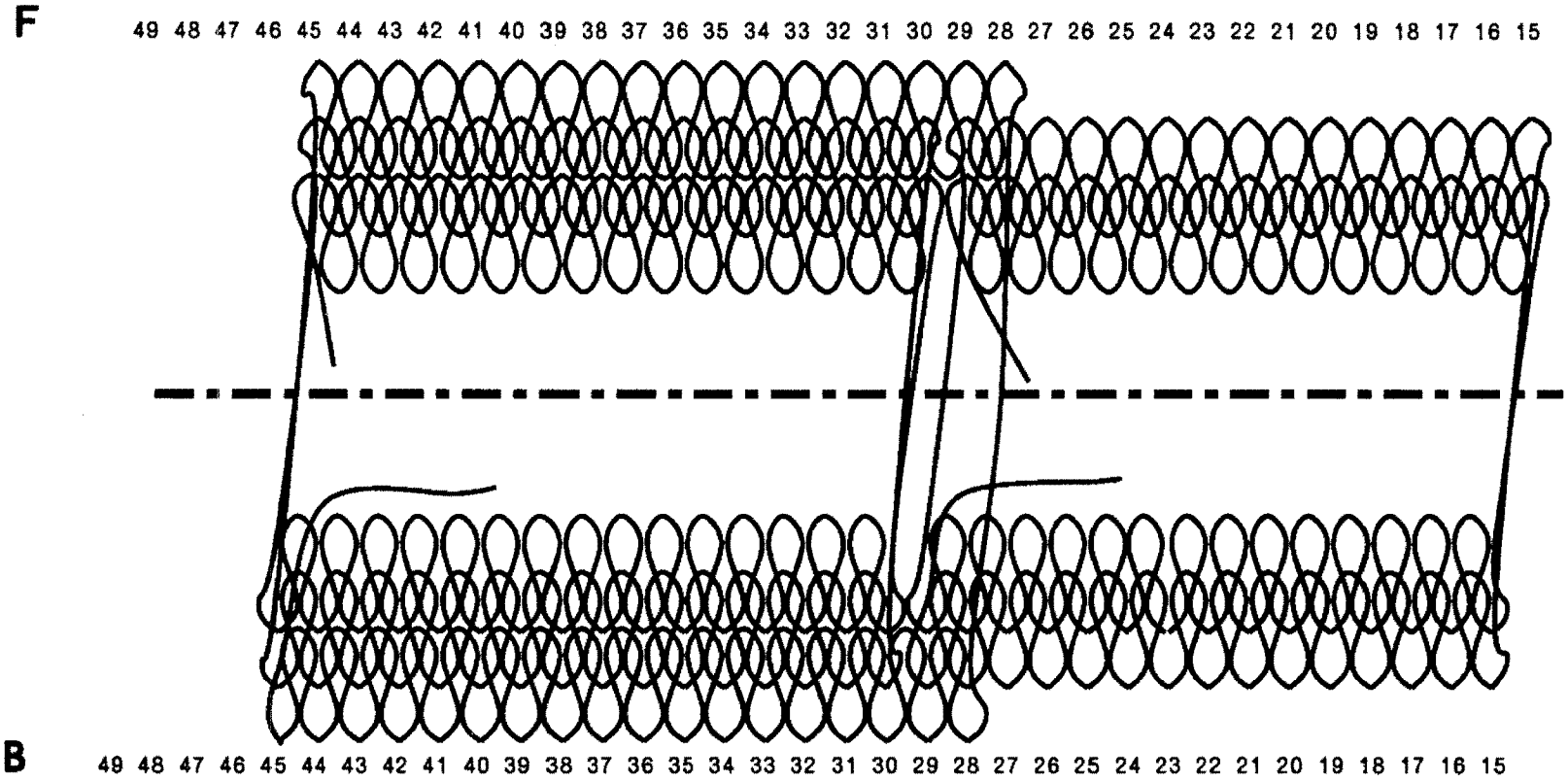
FIG. 6 is a schematic explanatory diagram for the sake of explanation of a stitch structure in a between-finger part in the method for manufacturing a glove according to the same embodiment, showing a state in which a pouch base part of the middle finger pouch-like part has been knitted.
Figure 7:
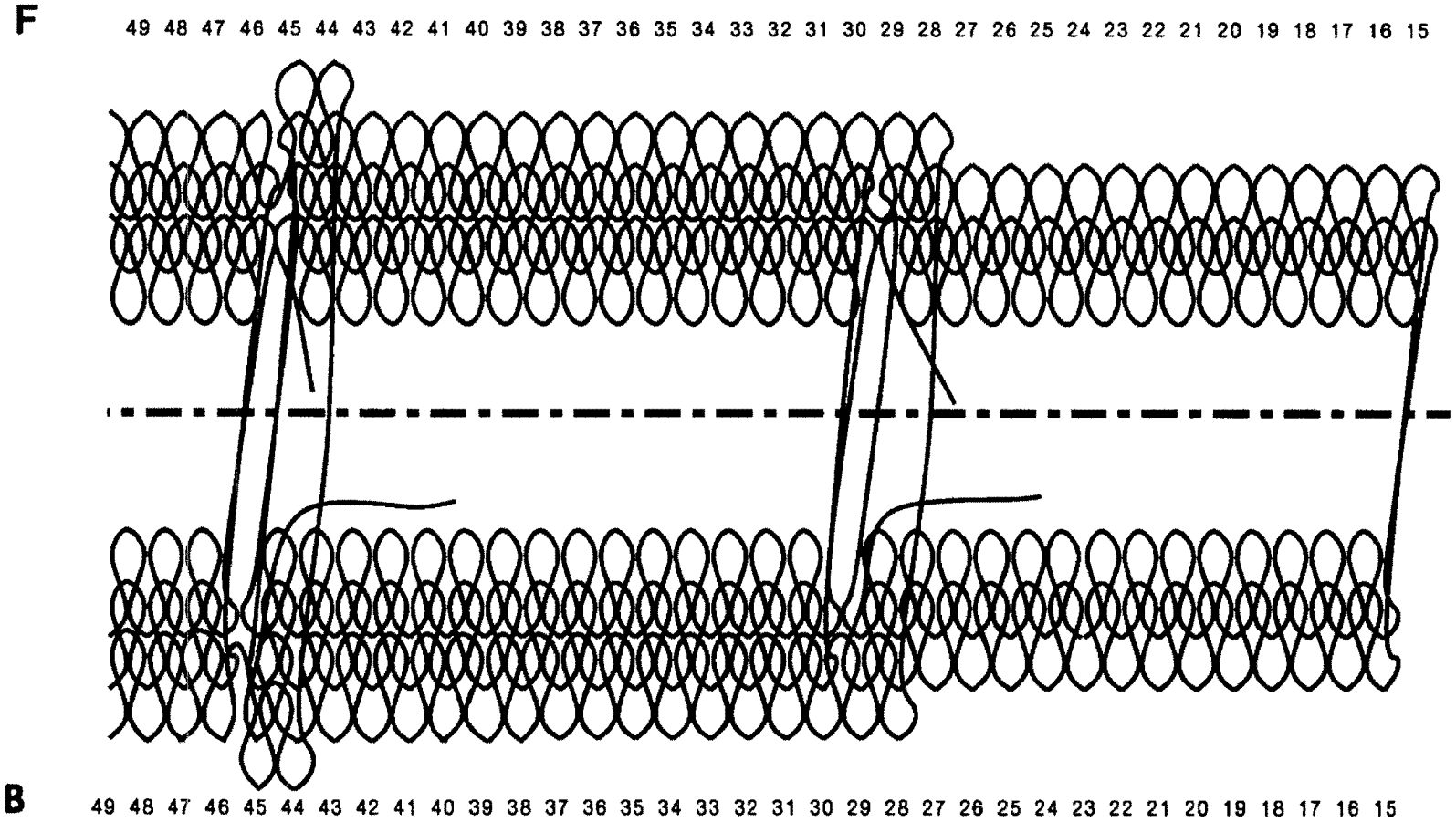
FIG. 7 is a schematic explanatory diagram for the sake of explanation of a stitch structure in a between-finger part in the method for manufacturing a glove according to the same embodiment, showing a state in which a pouch base part of an index finger pouch-like part has been knitted.
Figure 8:
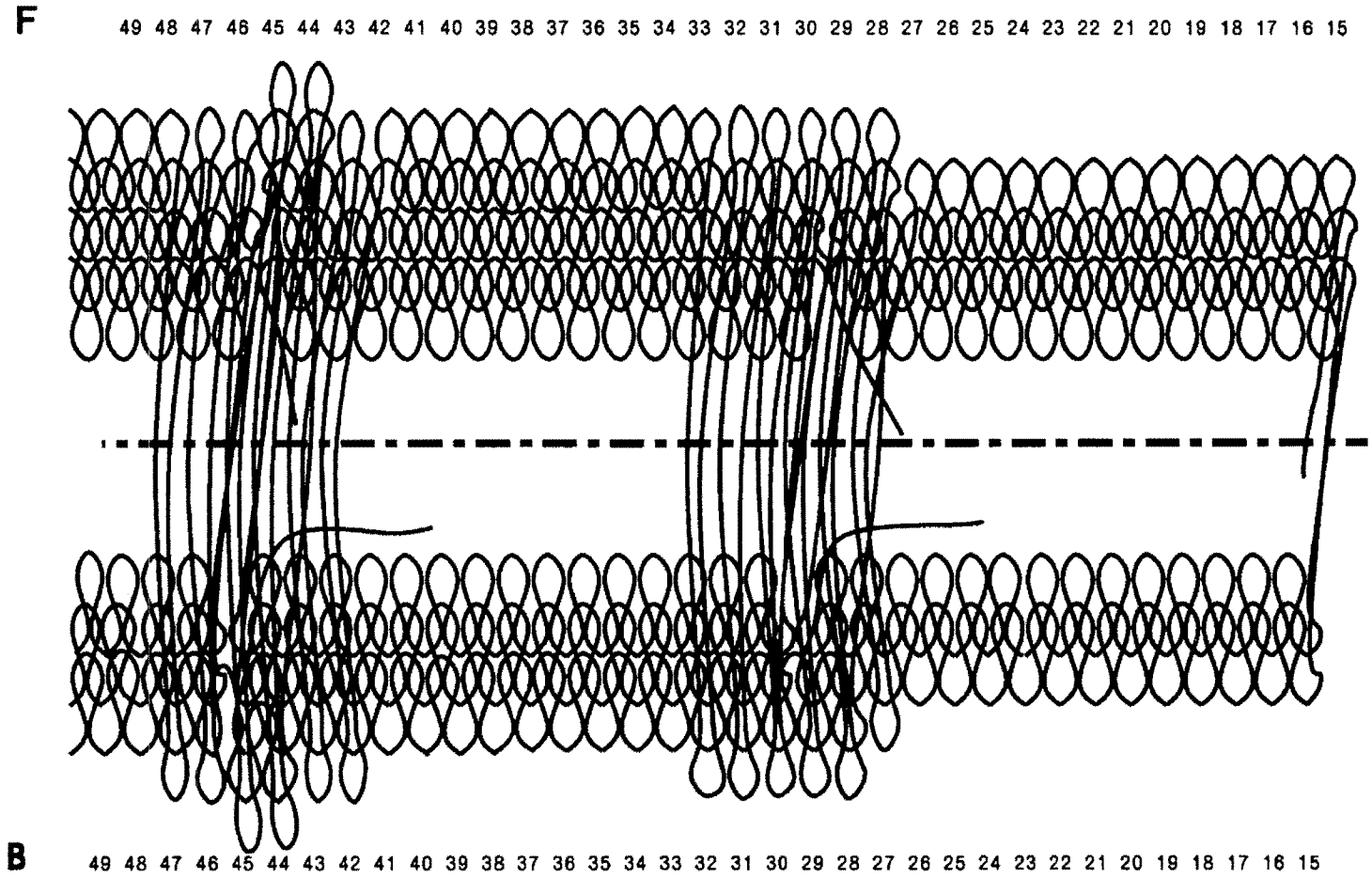
FIG. 8 is a schematic explanatory diagram for the sake of explanation of a stitch structure in a between-finger part in the method for manufacturing a glove according to the same embodiment, showing a state in which a first front and rear cloth connecting part and a second front and rear cloth connecting part have been knitted.

The present method for manufacturing a glove, as shown in FIG. 3, includes: the ring finger pouch-like part forming step S200 of knitting the ring finger pouch-like part by way of the ring finger knitting needle group (15 to 29 in FIG. 3) (the first pouch-like part forming step (refer to F10 to F17 and B10 to B17 in FIGS. 1 and 2)); the middle finger poach-like part forming step S300 of knitting the middle finger pouch-like part after the ring finger pouch-like part forming step S200 (the second pouch-like part forming step (refer to F19 to F27 and B19 to B27 in FIGS. 1 and 2)); and the index finger pouch-like part forming step S400 of knitting the index finger pouch-like part after the middle finger pouch-like part forming step S300 (the third pouch-like part forming step (refer to F28 to F36 and B28 to B36 in FIGS. 1 and 2)).

In addition, the pinky finger pouch-like part forming step S100 of the present method for manufacturing a glove is a step of knitting the pinky finger pouch-like part as shown in FIGS. 1 and 2 by way of the pinky finger knitting needle group (1 to 14 in FIGS. 1 and 2) (refer to F1 to F8 and B1 to B8 of FIGS. 1 and 2, which is performed before the ring finger pouch-like part forming step S200. The three finger trunk pouch-like part forming step S600 is a step of knitting the three finger trunk pouch-like part after, which is provided consecutively from the index finger pouch-like part, the middle finger, and the ring finger pouch-like part toward a wrist after the index finger pouch-like part forming step S400 (refer to F38 to F39 and B38 to B39 in FIGS. 1 and 2). The four finger trunk pouch-like part forming step S800 is a step of knitting the four finger trunk pouch-like part which is provided consecutively from the three finger trunk pouch-like part and the pinky finger pouch-like part toward a wrist, by way of the three finger trunk knitting needle group including: the index finger knitting needle group; the middle finger knitting needle group; and the ring finger knitting needle group, as well as the pinky finger knitting needle group (1 to 62 in FIGS. 1 and 2) after the pinky finger pouch-like part forming step S100 and the three finger trunk pouch-like part forming step S600 (refer to F41 and B41 in FIGS. 1 and 2). The thumb pouch-like part forming step S900 is a step of knitting the thumb pouch-like part after the four finger trunk pouch-like part forming step S800 (refer to F43 to F51 and B43 to B51 in FIGS. 1 and 2). The five finger trunk pouch-like part forming step S1100 is a step of knitting the pouch-like five finger trunk pouch-like part which is provided consecutively from the four finger trunk pouch-like part and the thumb pouch-like part toward a wrist after the thumb pouch-like part forming step S900 by means of the four finger trunk knitting needle group including the thumb knitting needle group, the index finger knitting needle group, the middle finger knitting needle group, the ring finger knitting needle group, and the pinky finger knitting needle group (1 to 80 in FIGS. 1 and 2) (refer to F53 and B53 in FIGS. 1 and 2).

Main Body Part Knitting Step

In addition, the middle finger pouch-like part forming step S300 has a main body part knitting step S310 of knitting the main body part of the middle finger pouch-like part, as shown in FIG. 3 (refer to F19 to F26 and B19 to B26 in FIG. 3). In the main body part knitting step S310, the middle finger knitting needle group (30 to 45 in FIG. 3) is used. It should be noted that, knitting of the main body part of the middle finger pouch-like part is performed in the same manner as knitting of a main body part in the conventional glove manufacturing method and the pouch-like part is knitted by increasing the number of knitting needles used course by course from a fingertip, so as to increase the diameter of the pouch-like part gradually from a fingertip (refer to F19 to F25 and B19 to B25 in FIG. 3), and then knitting a plurality of courses by way of a predetermined number (16) of knitting needles (refer to F26 and B26 in FIG. 3). It should be noted that, respective main body part knitting steps S110, S210, S410, and S910 of the pinky finger pouch-like part forming step S100, the ring finger pouch-like part forming step S200, the index finger pouch-like part forming step S400, and the thumb pouch-like part forming step S900 are performed in the same manner (refer to FIGS. 1 and 2).

Pouch Base Part Knitting Step

In addition, the middle finger pouch-like part forming step S300 includes a pouch base part knitting step S320 for knitting an annular pouch base part which is provided consecutively from the main body part of the middle finger pouch-like part toward a wrist, connecting the ring finger pouch-like part and the middle finger pouch-like part, after the main body part knitting step S310 (refer to F27 and B27 in FIG. 3). In the pouch base part knitting step S320, the middle finger knitting needle group (30 to 45 in FIG. 3) as well as 2 pairs of knitting needles in front and rear among the ring finger knitting needle group, that are adjacent to the middle finger knitting needle group (28 and 29 in FIG. 3 (hereinafter also referred to as "pouch-like part connecting knitting needle")) are used. More specifically, in the pouch base part knitting step S320, a front cloth of the pouch base part is knitted by way of knitting needles in a front row among the middle finger knitting needle group (30 to 45 on a lower side of FIG. 3) as well as 2 pouch-like part connecting knitting needles in a front row that are adjacent to the middle finger knitting needle group (28 and 29 on a lower side of FIG. 3 among the ring finger knitting needle group in a front row; and then a rear cloth of the pouch base part is knitted by way of 2 pouch-like part connecting knitting needles (28 and 29 on an upper side of FIG. 3) among the ring finger knitting needle group that are opposite to the 2 pouch-like part connecting knitting needles in the front row (28 and 29 on the lower side of FIG. 3) as well as knitting needles in a rear row among the middle finger knitting needle group (30 to 45 on an upper side of FIG. 3). Alternatively, it is possible to knit the rear cloth first and the front cloth second.

It should be noted that, the number of the pouch-like part connecting knitting needles used in the pouch base part knitting step S320 of the middle finger pouch-like part forming step S300 (the number of hooks) is preferably at least 2 pairs and no greater than 10 pairs (at least 4 hooks and no greater than 21 hooks in total of front and rear), more preferably at least 2 pairs and no greater than 6 pairs (at least 4 hooks and no greater than 13 hooks in total of front and rear), and particularly preferably at least 2 pairs and no greater than 4 pairs (at least 4 hooks and no greater than 9 hooks in total of front and rear). The number of the pouch-like part connecting knitting needles smaller than the above range may result in weaker connection between the middle finger pouch-like part and the ring finger pouch-like part leading to easy formation of a hole in the between-finger part; and the number of the pouch-like part connecting knitting needles greater than the above range may result in the ring finger pouch-like part having a too small inner diameter in a part thereof.

A single course of the pouch base part knitting step S320 is performed in the present embodiment; however, a plurality of courses thereof is also possible. It should be noted that the number of courses of the pouch base part knitting step S320 is preferably no greater than 3 courses and more preferably no greater than 2 courses. The number of courses greater than the above upper limit may result in a too large inclined part due to a difference in the number of courses between the ring finger pouch-like part and the middle finger pouch-like part that may give an uncomfortable sensation to a wearer and may cause defective coating during coating.

In addition, given that the number of courses of the pouch base part knitting step S320 being $T_1$ and the number of gauge being G, it is preferable that the number of courses $T_1$ satisfies the following relationship:

$$a \times T_1/G < 1$$

It should be noted that the above constant a is preferably at least 6 and no greater than 10 and more preferably at least 7 and no greater than 9. The constant a smaller than the above range increases the number of courses too much, which may give an uncomfortable sensation to a wearer in the between-finger part and may lead to defective coating; and, the constant a exceeding the above range decreases the number of courses too much, which may cause weaker connection between the middle finger pouch-like part and the ring finger pouch-like part, leading to easy formation of a hole in the between-finger part.

Main Body Part Knitting Step and Pouch Base Part Knitting Step in Other Pouch-Like Part Forming Steps Similarly to the middle finger pouch-like part forming step S300, the index finger pouch-like part forming step S400 includes the main body part knitting step S410 of knitting the main body part of the index finger pouch-like part (refer to F28 to F35 and B28 to B35 in FIGS. 1 and 2) and a pouch base part knitting step S420 for knitting an annular pouch base part which is provided consecutively from the main body part of the index finger pouch-like part toward a wrist, connecting the middle finger pouch-like part and the index finger pouch-like part (refer to F36 and B36 in FIGS. 1 and 2). In the main body part knitting step S410 of the index finger pouch-like part forming step S400, the index finger knitting needle group (46 to 62 in FIGS. 1 and 2) is used. In addition, in the pouch base part knitting step S420 of the index finger pouch-like part forming step S400, a front cloth of the pouch base part is knitted by way of knitting needles in a front row among the index finger knitting needle group (46 to 62 in FIG. 2) as well as 2 pouch-like part connecting knitting needles in a front row that are adjacent to the index finger knitting needle group (44 and 45 in FIG. 2) among the middle finger knitting needle group in a front row, and then a rear cloth of the pouch base part is knitted by way of 2 pouch-like part connecting knitting needles (44 and 45 in FIG. 1) among the middle finger knitting needle group that are opposite to the 2 pouch-like part connecting knitting needles in the front row, as well as knitting needles in a rear row among the index finger knitting needle group (46 to 62 in FIG. 1).

It should be noted that, in the index finger pouch-like part forming step S400, the order of knitting of the front and rear clothes, the number of pouch-like part connecting knitting needles, and the number of courses of the pouch base part knitting step S420 can be modified in various ways, similarly to the case of the middle finger pouch-like part forming step S300 described above.

It should be noted that, in the present embodiment, in addition to the middle finger pouch-like part forming step S300 and the index finger pouch-like part forming step S400 described above, the three finger trunk pouch-like part forming step S600 and the thumb pouch-like part forming step S900 also have respective main body part knitting processes 3610, 3910 and respective pouch base part knitting steps S620, S920 similar to the above.

To explain more specifically, the three finger trunk pouch-like part forming step S600 includes: the main body part knitting step S610 (refer to F38 and B38 in FIGS. 1 and 2) of knitting the main body part of the three finger trunk pouch-like part by way of the index finger knitting needle group (46 to 62 in FIGS. 1 and 2), the middle finger knitting needle group (30 to 45 in FIGS. 1 and 2), and the ring finger knitting needle group (15 to 29 in FIGS. 1 and 2); and the pouch base part knitting step S620 of knitting the annular pouch base part which is provided consecutively from the main body part of the three finger trunk pouch-like part toward a wrist, connecting the pinky finger pouch-like part and the three finger trunk pouch-like part (refer to F39 and B39 in FIGS. 1 and 2) by way of the index finger knitting needle group (46 to 62 in FIGS. 1 and 2), the middle finger knitting needle group (30 to 45 in FIGS. 1 and 2), the ring finger knitting needle group (15 to 29 in FIGS. 1 and 2), and 2 pairs, front and rear, of knitting needles, among the pinky finger knitting needle group, that are adjacent to the ring finger knitting needle group (13 and 14 in FIGS. 1 and 2 (pouch-like part connecting knitting needles)). In the pouch base part knitting step S620, one face of the pouch base part is knitted by way of knitting needles in one of two rows, front and rear, of the index finger knitting needle group (46 to 62 in FIGS. 1 and 2), the middle finger knitting needle group (30 to 45 in FIGS. 1 and 2), and the ring finger knitting needle group (15 to 29 in FIGS. 1 and 2), as well as 2 pouch-like part connecting knitting needles (13 and 14 in FIGS. 1 and 2), among the pinky finger knitting needle group in the one row, that are adjacent to the ring finger knitting needle group; and then the other face of the pouch base part is knitted by way of 2 pouch-like part connecting knitting needles (13 and 14 in FIGS. 1 and 2) that are opposite to the pouch-like part connecting knitting needles, as well as the index finger knitting needle group (46 to 62 in FIGS. 1 and 2), the middle finger knitting needle group (30 to 45 in FIGS. 1 and 2), and the ring finger knitting needle group (15 to 29 in FIGS. 1 and 2).

In addition, the thumb pouch-like part forming step S900 includes: the main body part knitting step S910 (refer to F43 to F50 and B43 to B50 in FIGS. 1 and 2) of knitting the main body part of the thumb pouch-like part by way of the thumb knitting needle group (63 to 80 in FIG. 1); and the pouch base part knitting step S920 of knitting the annular pouch base part which is provided consecutively from the main body part of the thumb pouch-like part toward a wrist, connecting the four finger trunk pouch-like part and the thumb pouch-like part (refer to F51 and B51 in FIGS. 1 and 2) by way of the thumb knitting needle group, as well as 2 pairs, front and rear, of knitting needles, among the index finger knitting needle group, that are adjacent to the thumb knitting needle group (61 and 62 in FIG. 1 or 2 (pouch-like part connecting knitting needles)). In the pouch base part knitting step S920, one face of the pouch base part is knitted by way of knitting needles in one of two rows, front and rear, of the thumb knitting needle group (63 to 80 in FIG. 1 or 2) as well as 2 pouch-like part connecting knitting needles (61 and 62 in FIG. 1 or 2), among the index finger knitting needle group in the one row, that are adjacent to the thumb knitting needle group; and then the other face of the pouch base part is knitted by way of 2 pouch-like part connecting knitting needles (61 and 62 in FIG. 1 or 2) that are opposite to the pouch-like part connecting knitting needles, as well as the knitting needles in the other row of the thumb knitting needle group (63 to 80 in FIG. 1 or 2).

It should be noted that, in the three finger trunk pouch-like part forming step S600 and the thumb pouch-like part forming step S900, the order of knitting of the front and rear clothes, the number of pouch-like part connecting knitting needles, and the number of courses of the pouch base part knitting step can be modified in various ways, similarly to the case of the middle finger pouch-like part forming step S300 described above.

Front and Rear Cloth Connecting Step

The present method for manufacturing a glove also includes the front and rear cloth connecting step S500 of connecting the front cloth and the rear cloth in the between-finger part. The front and rear cloth connecting step S500 is a step of knitting the first front and rear cloth connecting part that connects the front cloth and the rear cloth in the between-finger part between the middle finger pouch-like part and the ring finger pouch-like part (refer to F37 and B37 in FIG. 3). The front and rear cloth connecting step S500 further knits the second front and rear cloth connecting part, along with the first front and rear cloth connecting part, that connects the front cloth and the rear cloth in the between-finger part between the index finger pouch-like part and the middle finger pouch-like part, in the same course.

The front and rear cloth connecting step S500, which knits the first and second front and rear cloth connecting parts, takes place after any of the main body part knitting step S310 and the pouch base part knitting step S320 of the middle finger pouch-like part forming step S300, as well as the main body part knitting step S410 and the pouch base part knitting step S420 of the index finger pouch-like part forming step S400. More specifically, the front and rear cloth connecting step S500 is performed subsequent to the pouch base part knitting step S420 of the index finger pouch-like part forming step S400.

Here, the front and rear cloth connecting step S500, which connects the first front and rear cloth connecting part (and the second front and rear cloth connecting part) is performed for half a course in the present embodiment; however, the step can be performed for at least 1 course in a case in which the strength of the front and rear cloth connecting parts is insufficient.

As knitting needles for knitting the first front and rear cloth connecting part in the front and rear cloth connecting step S500, 2 pairs of knitting needles in front and rear among the ring finger knitting needle group, that are adjacent to the middle finger knitting needle group (28 and 29 in FIG. 3) are used. In other words, the pouch-like part connecting knitting needles (28 and 29 in FIG. 3), which are used in the pouch base part knitting step S320 of the middle finger pouch-like part forming step S300, are used as knitting needles for knitting the first front and rear cloth connecting part.

In addition, as knitting needles for knitting the first front and rear cloth connecting part, along with the pouch-like part connecting knitting needles (28 and 29 in FIG. 3), at least 1 pair of knitting needles, front and rear (26 and 27, as well as 30 and 31 in FIG. 3 (hereinafter also referred to as first front and rear connecting knitting needles)), that are adjacent to the pouch-like part connecting knitting needles (28 and 29 in FIG. 3) on at least one side thereof are used. In the present embodiment, knitting needles which are adjacent to the pouch-like part connecting knitting needles on both sides thereof are used as the first front and rear connecting knitting needles (26 and 27, as well as 30 and 31 in FIG. 3).

Here, among the first front and rear connecting knitting needles, the first front and rear connecting knitting needles which are positioned on a side to the ring finger pouch-like part (26 and 27 in FIG. 3) are provided in 1 pair or a plurality of pairs. Here, the number (hook number) of the first front and rear connecting knitting needles on a side to the ring finger pouch-like part is preferably at least 1 pair and no greater than 4 pairs (at least 2 hooks and no greater than 9 hooks in total of front and rear), more preferably at least 2 pairs and no greater than 3 pairs (at least 4 hooks and no greater than 7 hooks in total of front and rear), and particularly preferably 2 pairs (at least 4 hooks and no greater than 5 hooks in total of front and rear). If the number of the first front and rear connecting knitting needles on a side to the ring finger pouch-like part is smaller than the above specified lower limit, connection between the front cloth and the rear cloth is weak, leading to easy formation of a hole in the between-finger part; on the other hand, if the number of the first front and rear connecting knitting needles on a side to the ring finger pouch-like part exceeds the above specified upper limit, the ring finger pouch-like part may have a too small inner diameter in a part thereof.

In addition, among the first front and rear connecting knitting needles, the first front and rear connecting knitting needles which are positioned on a side to the middle finger pouch-like part (30 and 31 in FIG. 3) are provided in 1 pair or a plurality of pairs. Here, the number (hook number) of the first front and rear connecting knitting needles on a side to the middle finger pouch-like part is preferably at least 1 pair and no greater than 4 pairs (at least 2 hooks and no greater than 9 hooks in total of front and rear), more preferably at least 2 pairs and no greater than 3 pairs (at least 4 hooks and no greater than 7 hooks in total of front and rear, and particularly preferably 2 pairs (at least 4 hooks and no greater than 5 hooks in total of front and rear). If the number of the first front and rear connecting knitting needles on a side to the middle finger pouch-like part is smaller than the above specified lower limit, connection between the front cloth and the rear cloth is weak, leading to easy formation of a hole in the between-finger part; on the other hand, if the number of the first front and rear connecting knitting needles on a side to the middle finger pouch-like part exceeds the above specified upper limit, the middle finger pouch-like part may have a too small inner diameter in a part thereof.

It should be noted that, the number (hook number (total of those on a side to the ring finger pouch-like part and those on a side to the middle finger pouch-like part), of the first front and rear connecting knitting needles (26 and 27, as well as 30 and 31 in FIG. 3) is preferably at least 1 time and no greater than 3 times, and more preferably at least 1.5 times and no greater than 2.5 times greater than the number (hook number) of the pouch-like part connecting knitting needles (28 and 29 in FIG. 3) which are for knitting the first front and rear cloth connecting part. If the number of the first front and rear connecting knitting needles is smaller than the above specified lower limit, connection between the front cloth and the rear cloth is weak, leading to easy formation of a hole in the between-finger part; on the other hand, if the number of the first front and rear connecting knitting needles exceeds the above specified upper limit, the between-finger part may lack flexibility, giving an uncomfortable sensation to a wearer and leading to defective coating.

As knitting needles for knitting the second front and rear cloth connecting part in the front and rear cloth connecting step S500, 2 pairs of knitting needles in front and rear among the middle finger knitting needle group, that are adjacent to the index finger knitting needle group (44 and 45 in FIG. 3) are used. In other words, the pouch-like part connecting knitting needles (44 and 45 in FIG. 3), which are used in the pouch base part knitting step S420 of the index finger pouch-like part forming step S400, are used as knitting needles for knitting the second front and rear cloth connecting part.

In addition, as knitting needles for knitting the second front and rear cloth connecting part, along with the pouch-like part connecting knitting needles (44 and 45 in FIG. 3), at least 1 pair of knitting needles, front and rear (42, 43, 46 and 47 in FIG. 3 (hereinafter also referred to as second front and rear connecting knitting needles)), that are adjacent to the pouch-like part connecting knitting needles (44 and 45 in FIG. 3) on at least one side thereof are used. In the present embodiment, knitting needles which are adjacent to the pouch-like part connecting knitting needles (44 and 45 in FIG. 3) on both sides thereof are used as the second front and rear connecting knitting needles (42, 43, 46 and 47 in FIG. 3).

Here, among the second front and rear connecting knitting needles, the second front and rear connecting knitting needles which are positioned on a side to the middle finger pouch-like part (42 and 43 in FIG. 3) are provided in 1 pair or a plurality of pairs. Here, the number (hook number) of the second front and rear connecting knitting needles on a side to the middle finger pouch-like part is preferably at least 1 pair and no greater than 4 pairs (at least 2 hooks and no greater than 9 hooks in total of front and rear), more preferably at least 2 pairs and no greater than 3 pairs (at least 4 hooks and no greater than 7 hooks in total of front and rear), and particularly preferably 2 pairs (at least 4 hooks and no greater than 5 hooks in total of front and rear). If the number of the second front and rear connecting knitting needles on a side to the middle finger pouch-like part is smaller than the above specified lower limit, connection between the front cloth and the rear cloth is weak, leading to easy formation of a hole in the between-finger part; on the other hand, if the number of the second front and rear connecting knitting needles on a side to the middle finger pouch-like part exceeds the above specified upper limit, the middle finger pouch-like part may have a too small inner diameter in a part thereof.

In addition, among the second front and rear connecting knitting needles, the second front and rear connecting knitting needles which are positioned on a side to the index finger pouch-like part (46 and 47 in FIG. 3) are provided in 1 pair or a plurality of pairs. Here, the number (hook number) of the second front and rear connecting knitting needles on a side to the index finger poach-like part is preferably at least 1 pair and no greater than 4 pairs (at least 2 hooks and no greater than 9 hooks in total of front and rear), more preferably at least 2 pairs and no greater than 3 pairs (at least 4 hooks and no greater than 7 hooks in total of front and rear), and particularly preferably 2 pairs (at least 4 hooks and no greater than 5 hooks in total of front and rear). If the number of the second front and rear connecting knitting needles on a side to the index finger pouch-like part is smaller than the above specified lower limit, connection between the front cloth and the rear cloth is weak, leading to easy formation of a hole in the between-finger part; on the other hand, if the number of the second front and rear connecting knitting needles on a side to the index finger pouch-like pare exceeds the above specified upper limit, the index finger pouch-like part may have a too small inner diameter in a part thereof.

It should be noted that, the number (hook number (total of those on a side to the middle finger pouch-like part and those on a side to the index finger pouch-like part)) of the second front and rear connecting knitting needles (42, 43, 46 and 47 in FIG. 3) is preferably at least 1 time and no greater than 3 times, and more preferably at least 1.5 times and no greater than 2.5 times greater than the number (hook number) of the pouch-like part connecting knitting needles (44 and 45 in FIG. 3) which are for knitting the second front and rear cloth connecting part. If the number of the second front and rear connecting knitting needles is smaller than the above specified lower limit, connection between the front cloth and the rear cloth is weak, leading to easy formation of a hole in the between-finger part; on the other hand, if the number of the second front and rear connecting knitting needles exceeds the above specified upper limit, the between-finger part may lack flexibility, giving an uncomfortable sensation to a wearer and leading to defective coating.

In the front and rear cloth connecting step S500 for knitting the first front and rear cloth connecting part and the second front and rear cloth connecting part, in addition to the above described knitting needles, other knitting needles (15 to 25, 32 to 43, and 48 to 62 in FIG. 1) on one of front and rear sides (rear side) are also used (refer to B37 in FIG. 1). In other words, in the present step, the rear cloth is knitted while the front cloth and the rear cloth are connected to each other through the first front and rear cloth connecting part and the second front and rear cloth connecting part, in the between-finger part between the middle finger pouch-like part and the ring finger pouch-like part, as well as in the between-finger part between the index finger pooch-like part and the middle finger pouch-like part.

It should be noted that, in the present embodiment, the present method for manufacturing a glove further includes: the front and rear cloth connecting step S700 (refer to F40 and B40 in FIGS. 1 and 2; for knitting the third front and rear cloth connecting part which connects the front cloth and the rear cloth in the between-finger part between the pinky finger pouch-like part and the ring finger pouch-like part (three finger trunk pouch-like part); and the front and rear cloth connecting step S1000 (refer to F52 and B52 in FIGS. 1 and 2) for knitting the fourth front and rear cloth connecting part which connects the front cloth and the rear cloth in the between-finger part between the index finger pooch-like part (four finger trunk pouch-like part) and the thumb pouch-like part.

The front and rear cloth connecting step S700 for knitting the third front and rear cloth connecting part and the front and rear cloth connecting step S1000 for knitting the fourth front and rear cloth connecting part are performed in different courses.

The front and rear cloth connecting step S700 of knitting the third front and rear cloth connecting part is a step of connecting the front cloth and the rear cloth in the between-finger part between the three finger trunk pouch-like part and the pinky finger pouch-like part, performed after the pouch base part knitting step S620 of the three finger trunk pouch-like part forming step S600. In addition, the front and rear cloth connecting step S1000 of the fourth front and rear cloth connecting part is a step of connecting the front cloth and the rear cloth in the between-finger part between the thumb pouch-like part and the four finger trunk pouch-like part, performed after the pouch base part knitting step S920 of the thumb pouch-like part forming step S900.

It should be noted that, the front and rear cloth connecting step S700 of knitting the third front and rear cloth connecting part and the front and rear cloth connecting step S1000 of knitting the fourth front and rear cloth connecting part are performed for half a course in the present embodiment; however, the step can be performed for at least 1 course in a case in which the strength of the front and rear cloth connecting parts is insufficient.

Glove

According to the above described method for manufacturing a glove, a glove is knitted in which a trunk pouch-like part and a plurality of finger pouch-like parts corresponding to respective fingers that is provided protrudingly from the trunk pouch-like part are composed of the front cloth and the rear cloth. More specifically, in the glove, the thumb pouch-like part and the four finger trunk pouch-like part are provided protrudingly from the five finger trunk pouch-like part; the pinky finger pouch-like part and the three finger trunk pouch-like part are provided protrudingly from the four finger trunk pouch-like part; and the index finger pouch-like part, the middle finger pouch-like part, and the ring finger pouch-like part are provided protrudingly from the three finger trunk pouch-like part.

In addition, in the glove, the middle finger pouch-like part has the main body part and the annular pouch base part which is provided consecutively from the main body part toward a wrist. The pouch base part has: the front face portion which is provided consecutively from the front cloth of the main body part toward a wrist; the pouch-like part connecting front side portion which is continued from the front face portion in the same course and is provided consecutively from the front cloth of two stitches of the ring finger pouch-like part toward a wrist; the pouch-like part connecting rear side portion which is continued from the pouch-like part connecting front side portion in the same course and is provided consecutively from the rear cloth of two stitches of the ring finger pouch-like part toward a wrist; and the rear face portion which is continued from the pouch-like part connecting rear side portion in the same course and is provided consecutively from the rear cloth of the main body part toward a wrist.

Furthermore, in the glove, the index finger pouch-like part has the main body part and the annular pouch base part which is provided consecutively from the main body part toward a wrist. The pouch base part has: the front face portion which is provided consecutively from the front cloth of the main body part toward a wrist; the pouch-like part connecting front side portion which is continued from the front face portion in the same course and is provided consecutively from the front cloth of two stitches of (the front face portion of the pouch base part of) the middle finger poach-like part toward a wrist; the pouch-like part connecting rear side portion which is continued from the pouch-like part connecting front side portion in the same course and is provided consecutively from the rear cloth of two stitches of (the rear face portion of the pouch base part of) the middle finger pouch-like part toward a wrist; and the rear face portion which is continued from the pouch-like part connecting rear side portion in the same course and is provided consecutively from the rear cloth of the main body part toward a wrist.

Moreover, in the glove, the three finger trunk pouch-like part has the main body part and the annular pouch base part which is provided consecutively from the main body part toward a wrist. The pouch base part of the three finger trunk pouch-like part has: the front face portion which is provided consecutively from the front cloth of the main body part toward a wrist; the pouch-like part connecting front side portion which is continued from the front face portion in the same course and is provided consecutively from the front cloth of two stitches of the pinky finger pouch-like part toward a wrist; the pouch-like part connecting rear side portion which is continued from the pouch-like part connecting front side portion in the same course and is provided consecutively from the rear cloth of two stitches of the pinky finger pouch-like part toward a wrist; and the rear face portion which is continued from the pouch-like part connecting rear side portion in the same course and is provided consecutively from the rear cloth of the main body part toward a wrist.

Moreover, in the glove, the thumb pouch-like part has the main body part and the annular pouch base part which is provided consecutively from the main body part toward a wrist. The pouch base part of the thumb pouch-like part has: the front face portion which is provided consecutively from the front cloth of the main body part toward a wrist; the pouch-like part connecting front side portion which is continued from the front face portion in the same course and is provided consecutively from the front cloth of two stitches of the four finger trunk pouch-like part toward a wrist; the pouch-like part connecting rear side portion which is continued from the pouch-like part connecting front side portion in the same course and is provided consecutively from the rear cloth of two stitches of the four finger trunk pouch-like part toward a wrist; and the rear face portion which is continued from the pouch-like part connecting rear side portion in the same course and is provided consecutively from the rear cloth of the main body part toward a wrist. The pouch-like part connecting front side portion and the pouch-like part connecting rear side portion are knitted by the respective pouch-like part connecting knitting needles described above.

It should be noted that the number of stitches in the pouch-like part connecting front side portion and the pouch-like part connecting rear side portion of each of the pouch base parts is not limited to two, and the number of stitches described above in the method for manufacturing a glove can be employed. In addition, with regard to the number of courses for each of the pouch base parts, the number of courses described above in the method for manufacturing a glove can be employed.

In addition, the glove has the front and rear cloth connecting part for connecting the front cloth and the rear cloth in the between-finger part between the pouch-like parts. More specifically, the glove has: the first front and rear cloth connecting part provided in the between-finger part between the middle finger pouch-like part and the ring finger pouch-like part; the second front and rear cloth connecting part provided in the between-finger part between the index finger pouch-like part and the middle finger pouch-like part; the third front and rear cloth connecting part provided in the between-finger part between the ring finger pouch-like part (three finger trunk pouch-like part) and the pinky finger pouch-like part; and the fourth front and rear cloth connecting part provided in the between-finger part between the thumb pouch-like part and the index finger pouch-like part (four finger trunk pouch-like part). Here, the first front and rear cloth connecting part and the second front and rear cloth connecting part are knitted in the same course.

Each of the front and rear cloth connecting parts is provided in a wale direction of the pouch-like part connecting front side portion and the pouch-like part connecting rear side portion in each of the between-finger parts, on the side to the wrist. Each of the front and rear cloth connecting parts is knitted by the respective pouch-like part connecting knitting needles and the respective front and rear connecting knitting needles that are described above. Given this, the front and rear cloth connecting part is provided to be greater in width than the pouch-like part connecting front side portion and the pouch-like part connecting rear side portion. In other words, the front and rear cloth connecting part has a central part which is knitted by the pouch-like part connecting knitting needle and a side part which is adjacent to the central part and knitted by the front and rear connecting knitting needle. Here, the number of stitches in the side part can be the number described in the number of the front and rear connecting knitting needles (hook number) in the method for manufacturing a glove. Furthermore, the number of courses for the front and rear cloth connecting part can be the number of courses described in the front and rear cloth connecting steps S500, S700, and S1000 in the method manufacturing a glove.

Method for Manufacturing Coated Glove

Next, a method for manufacturing a coated glove using the glove configured as described above is explained.

The method for manufacturing a coated glove includes a coating layer forming step of forming a coating layer at least in a palm region of the glove. For the coating layer forming step, a conventionally known method can be employed. More specifically, the glove is fitted onto a three dimensional model, the palm region of the glove is immersed in a coating layer forming material, and the coating layer forming material thus applied is dried, thereby forming a coating layer.

Coated Glove

The coating layer thus manufactured by the method for manufacturing a coated glove includes the glove configured as described above and the coating layer formed at least in the palm region of the glove.

Advantages

The present invention configured as described above has the following advantages.

In other words, in the glove, the annular pouch base part is provided consecutively from the main body part of, for example, the middle finger pouch-like part toward a wrist, the annular pouch base part connecting the ring finger pouch-like part and the middle finger pouch-like part. In addition, the pouch base part is woven into two stitches respectively on the front and rear sides (four stitches in total of front and rear) among the stitches of the ring finger pouch-like part, adjacent to the middle finger pouch-like part. The ring finger pouch-like part and the middle finger pouch-like part are thus firmly connected in both the front and the rear sides in the front cloth (the front face portion and the pouch-like part connecting front side portion) and the rear cloth (the rear face portion and the pouch-like part connecting rear side portion), allowing effective prevention of formation of a hole in the between-finger part.

In addition, since the pouch-like part connecting front side portion and the pouch-like part connecting rear side portion are respectively woven into two stitches in the ring finger pouch-like part, the ring finger pouch-like part and the middle finger pouch-like part can be connected more firmly and formation of a hole in the between-finger part can be prevented more effectively.

Furthermore, similar connections are made also in other between-finger parts, effectively preventing formation of a hole in the between-finger parts.

Moreover, in the method for manufacturing a glove, the glove can be manufactured more easily and more infallibly than in the conventional manufacturing method employing the holding bar. In addition, in the method for manufacturing a glove, since the control of the knitting needles can be more easily performed compared to the conventional method that knits the last three round courses in different patterns, the glove can be easily and infallibly manufactured using a flat knitting machine in which knitting needles are controlled by drum pins. Particularly the glove manufactured by the present manufacturing method has a simpler structure in the between-finger part compared to a glove manufactured by the conventional last three courses in different patterns and does not tend to give an uncomfortable sensation to a wearer, meanwhile a force applied to the between-finger part is distributed uniformly and does not easily form a hole.

In addition, since the glove has the first front and rear cloth connecting part that connects the front cloth and the rear cloth in the between-finger part between the middle finger pouch-like part and the ring finger pouch-like part, preventing formation of a hole in the between-finger part. Particularly, the first front and rear cloth connecting part is knitted by using the same knitting needle as the pouch-like part connecting knitting needle for knitting the pouch base part of the middle finger pouch-like part, thus positioning the first front and rear cloth connecting part in a wale direction of the pouch-like part connecting front side portion and the pouch-like part connecting rear side portion. The first front and rear cloth connecting part prevents an anteroposterior separating force from being applied to the pouch-like part connecting front side portion and the pouch-like part connecting rear side portion, preventing formation of a hole in the pouch base part more effectively.

Furthermore, since the first front and rear cloth connecting part is positioned more on a wrist side than the pouch-like part connecting front side portion and the like in the pouch base part of the middle finger pouch-like part, a force in a direction of separating the between-finger part tends to be directed to the front and rear cloth connecting part and the anteroposterior separating force is not easily applied to the pouch-like part connecting front side portion and the pouch-like part connecting rear side portion, preventing formation of a hole in the between-finger part more effectively.

Moreover, since the first front and rear cloth connecting part is knitted in the same course as the second front and rear cloth connecting part in the between-finger part between the index finger pouch-like part and the middle finger pouch-like part, a plurality of front and rear cloth connecting parts can be knitted in the same course, the knitting needles can be controlled easily, and easy and infallible manufacture using a generally used flat knitting machine is possible. In addition, since a plurality of front and rear cloth connecting parts can be knitted in the same course, manufacturing time can be reduced. It should be noted that, in the present invention, it is possible to provide the first front and rear cloth connecting part more on a fingertip side than the pouch-like part connecting front side portion and the like; however, in such a case, there are problems of the first front and rear cloth connecting part being exposed to the outer face side in the between-finger part, and control of the knitting needle being more complex since knitting in the same course as the front and rear cloth connecting parts in other between-finger parts is difficult.

It should be noted that the glove has the second front and rear cloth connecting part, the third front and rear cloth connecting part, and the fourth front and rear cloth connecting part in the respective between-finger parts that are configured similarly to the first front and rear cloth connecting part, and providing the same effect as that of the first front and rear cloth connecting part.

Since the glove is resistant to formation of a hole in the between-finger part as described above, defective coating is less likely in the between-finger part when the coating layer is to be formed while the glove is fitted onto a hand model.

Other Embodiments

It should be noted that, in addition to the above described modes, the present invention can be carried out in various modified and improved modes.

In other words, a case of forming the three finger trunk pouch-like part has been exemplified and described in the above embodiments; however, the present invention is not limited thereto. For example, a method of sequentially knitting the pinky finger pouch-like part, the ring finger pouch-like part, the middle finger pouch-like part, the index finger pouch-like part, the four finger trunk pouch-like part, the thumb pouch-like part, and the five finger trunk pouch-like part can be employed. Such a method for manufacturing a glove is a manufacturing method substantially the same as the above embodiment, but the ring finger pouch-like part forming step S200 includes: the main body part knitting step S210 of knitting the main body part of the ring finger pouch-like part by means of the ring finger knitting needle group; and a pouch-like part knitting step S220 of knitting the annular pouch base part which is provided consecutively from the main body part of the ring finger pouch-like part toward a wrist and connects the ring finger pouch-like part and the pinky finger pouch-like part by means of the ring finger knitting needle group as well as knitting needles on the front and rear sides, among the pinky finger knitting needle group, that are adjacent to the ring finger knitting needle group. It should be noted that, for the pouch-like part knitting step S220, the same method as the knitting method for other between-finger parts described above can be employed. In addition, after the index finger pouch-like part forming step S400, the four finger trunk pouch-like part forming step S800 takes place without knitting the three finger trunk pouch-like part. Furthermore, in this case, the third front and rear cloth connecting part in the between-finger part between the ring finger pouch-like part and the pinky finger pouch-like part can be knitted in the same course as the first front and rear cloth connecting part and the second front and rear cloth connecting part, as the front and rear cloth connecting step S500, S700, and S1000.

In the method for manufacturing a glove of the above embodiment, a method using a conventionally known flat knitting machine has been described; however, the present invention is not limited thereto. In other words, in the above embodiment, a machine in which knitting needles each having a hook are arranged in respective needle grooves, namely a machine in which a knitting needle corresponds to a hook, has been exemplified and described; however, the present invention is not limited thereto. More specifically, the present method for manufacturing a glove can also be carried out using a flat knitting machine in which a knitting needle with one or more hooks is disposed in each needle groove singly or in combination of, thereby providing a knitting needle guiding structure with at least two hooks integrally operating with respect to a single needle groove (refer to Japanese Unexamined Patent Application Publication No. 2012-12757), and in this case, a single knitting needle corresponds to at least two hooks. In other words, the method for manufacturing a glove of the invention of the present application can also be carried out by using a flat knitting machine in which two hooks integrally operate with respect to a single needle groove. It should be noted that, in this case, a pin in a needle selection drum (rotating body) corresponds to two stitches of a glove. In addition, in a case of using a knitting needle with two hooks, in the pouch base part knitting step, the pouch base part can be knitted by means of the second knitting needle group, as well as at least a pair of knitting needles, in front and rear, among the first knitting needle group, that is adjacent to the second knitting needle group. As a result, a glove can be manufactured in which pouch base part has: the front face portion which is provided consecutively from the front cloth of the main body part toward a wrist; the pouch-like part connecting front side portion which is continued from the front face portion in the same course and is provided consecutively from the front cloth of two stitches on a second side of the pouch base part of another pouch-like part adjacent to one side of said pouch-like part, toward a wrist; the pouch-like part connecting rear side portion which is continued from the pouch-like part connecting front side portion in the same course and is provided consecutively from the rear cloth of two stitches of a second side of the pouch base part of another pouch-like part adjacent to one side of said pouch-like part, toward a wrist; and the rear face portion which is continued from the pouch-like part connecting rear side portion in the same course and is provided consecutively from the rear cloth of the main body part toward a wrist.

In addition, in the above embodiment, a glove in which the pouch-like part connection structure of the above described structure is formed in all between-finger parts has been described; however, the present invention is not limited thereto and a glove in which the pouch-like part connection structure is formed in at least one between-finger part is within a scope intended by the invention of the present application. Nevertheless, it is preferable to form the pouch-like part connection structure in the between-finger part between the ring finger pouch-like part and the middle finger pouch-like part, as well as in the between-finger part between the middle finger pouch-like part and the index finger pouch-like part, thereby allowing proper coating of portions in which coating defect is likely to occur.

Furthermore, in the above embodiment, a glove in which the front and rear cloth connecting part is formed has been described; however, the present invention is not limited thereto. In addition, even in a case of forming the front and rear cloth connecting part, it is not necessary to form in all the between-finger parts as in the above embodiment and it is possible to form the front and rear cloth connecting part only in one between-finger part. Nevertheless, it is preferable to form the front and rear cloth connecting part in the between-finger part between the ring finger pouch-like part and the middle finger pouch-like part, as well as in the between-finger part between the middle finger pouch-like part and the index finger pouch-like part, thereby allowing proper coating of portions in which coating defect is likely to occur.

As described above, the method for manufacturing a glove of the present invention allows easy manufacture of a glove that is resistant to formation of a hole in the between-finger part and therefore is preferably employed for a coated glove, in which a coating layer is formed on a glove, and the like.

EXPLANATION OF THE REFERENCE SYMBOLS

S100 Pinky finger pouch-like part forming step
S110 Main body part knitting step
S200 Ring finger pouch-like part forming step
S210 Main body part knitting step
S300 Middle finger pouch-like part forming step
S310 Main body part knitting step
S320 Pouch base part knitting step
S400 Index finger pouch-like part forming step
S410 Main body part knitting step
S420 Pouch base part knitting step
S500 Front and rear cloth connecting step
S600 Three finger trunk pouch-like part forming step
S610 Main body part knitting step
S620 Pouch base part knitting step
S700 Front and rear cloth connecting step
S800 Four finger trunk pouch-like part forming step
S900 Thumb pouch-like part forming step
S910 Main body part knitting step
S920 Pouch base part knitting step
S1000 Front and rear cloth connecting step
S1100 Five finger trunk pouch-like part forming step

The invention claimed is:

1. A method for manufacturing a glove using a flat knitting machine, the glove being provided with a front cloth and a rear cloth constituting a plurality of portions covering hand fingers, the plurality of portions comprising a first portion and a second portion adjacent to the first portion, wherein:

the first portion has a cylindrical main body part and an annular base part that is continued from the main body part of the first portion toward a wrist; and the second portion has a cylindrical main body part and an annular base part that is continued from the main body part of the second portion toward a wrist; and the second portion attaches to the first portion in the annular base part of the second portion, the flat knitting machine having a large number of knitting needles each having at least one hook, the knitting needles being arranged in a front row and a rear row in a state in which the hooks of the respective rows face each other, wherein the front cloth is knitted by the knitting needles in the front row, and the rear cloth is knitted by the knitting needles in the rear row, wherein, in each of the front row and the rear row, the large number of knitting needles are sectioned into a plurality of knitting needle groups, the plurality of knitting needle groups comprising a first knitting needle group that knits the first portion and a second knitting needle group that knits the second portion, the method comprising, successively: a step of knitting the first portion; and a step of knitting the second portion, wherein:

the step of knitting the first portion includes, successively, knitting of the cylindrical main body part of the first portion by the first knitting needle group, and knitting of the annular base part of the first portion;

the step of knitting the second portion includes, successively, knitting of the cylindrical main body part of the second portion, and knitting of the annular base part of the second portion; and the knitting of the annular base part of the second portion includes, successively, knitting the front cloth of the annular base part by the knitting needles in the front row, and knitting the rear cloth of the annular base part by the knitting needles in the rear row, wherein, in the knitting of the front cloth of the annular base part of the second portion by the knitting needles in the front row, knitting needles for knitting the front cloth of the annular base part of the second portion are:

knitting needles in the front row and in the second knitting needle group; and at least one knitting needle that is in the front row and in the first knitting needle group, that has been used for knitting of the main body part of the first portion, and that is adjacent to the second knitting needle group, wherein the at least one knitting needle that is for knitting the front cloth of the annular base part of the second portion, that is in the front row and in the first knitting needle group, that has been used for knitting of the main body part of the first portion, and that is adjacent to the second knitting needle group, corresponds to at least two hooks, and wherein, in the knitting of the rear cloth of the annular base part of the second portion by the knitting needles in the rear row, knitting needles for knitting the rear cloth of the annular base part of the second portion are:

at least one knitting needle that is in the rear row and in the first knitting needle group, that faces the at least one knitting needle for knitting the front cloth of the annular base part in the front row and in the first knitting needle group, that has been used for knitting of the main body part of the first portion, and that is adjacent to the second knitting needle group; and knitting needles in the rear row and in the second knitting needle group, wherein the at least one knitting needle that faces the at least one knitting needle that is for knitting the front cloth of the annular base part of the second portion, that is in the front row and in the first knitting needle group, that has been used for knitting of the main body part of the first portion, and that is adjacent to the second knitting needle group, corresponds to at least two hooks, the method further comprising, after the knitting of the cylindrical main body part of the second portion and the knitting of the annular base part of the second portion, knitting of a first front and rear cloth connecting part that connects the front cloth and the rear cloth in the first portion, wherein knitting needles for knitting the first front and rear cloth connecting part are:

the at least one knitting needle for knitting the front cloth of the annular base part in the knitting of the annular base part of the second portion, that is in the front row and in the first knitting needle group, that has been used for knitting of the main body part of the first portion, and that is adjacent to the second knitting needle group;

at least one knitting needle that is adjacent to the at least one knitting needle for knitting the front cloth of the annular base part, that is in the front row and in the first knitting needle group, that has been used for knitting of the main body part of the first portion, and that is adjacent to the second knitting needle group;

the at least one knitting needle that is in the rear row and in the first knitting needle group, that faces the at least one knitting needle for knitting the front cloth of the annular base part in the front row and in the first knitting needle group, that has been used for knitting of the main body part of the first portion, and that is adjacent to the second knitting needle group; and a knitting needle that is in the rear row and that is adjacent to the at least one knitting needle that faces the at least one knitting needle for knitting the front cloth of the annular base part in the front row and in the first knitting needle group, that has been used for knitting of the main body part of the first portion and that is adjacent to the second knitting needle group.

2. The method for manufacturing a glove according to claim 1, wherein:

the plurality of portions further comprises a third portion adjacent to the second portion on an opposite side to the first portion, the third portion having a cylindrical main body part and an annular base part, the annular base part of the third portion being continued from the main body part of the third portion toward a wrist and connecting the second portion and the third portion, the plurality of knitting needle groups further comprises a third knitting needle group that is a plurality of knitting needles for knitting a third portion, the third knitting needle group being adjacent to the second knitting needle group on an opposite side to the first knitting needle group, in each of the front row and the rear row facing each other, the method comprising a step of knitting the third portion by means of the third knitting needle group, wherein: the step of knitting the third portion comprises:

knitting of a cylindrical main body part of the third portion by means of the third knitting needle group, and knitting of the annular base part of the third portion; and a second front and rear cloth connecting part that connects the front cloth and the rear cloth in the second portion or the third portion is knitted in the same course as the first front and rear cloth connecting part.

3. A method for manufacturing a glove using a flat knitting machine, the glove being provided with a front cloth and a rear cloth constituting a plurality of portions covering hand fingers, the plurality of portions comprising a pinky finger portion, a ring finger portion adjacent to the pinky finger portion, a middle finger portion adjacent to the ring finger portion on an opposite side to the pinky finger portion, an index finger portion adjacent to the middle finger portion on an opposite side to the ring finger portion, a three finger trunk portion adjacent to the pinky finger portion, the three finger trunk portion being consecutively provided from the index finger portion, the middle finger portion and the ring finger portion toward a wrist, a four finger trunk portion being consecutively provided from the three finger trunk portion and the pinky finger portion toward a wrist, a thumb portion adjacent to the four finger trunk portion, and a five finger trunk portion being provided consecutively from the four finger trunk portion and the thumb portion toward a wrist, wherein:

the ring finger portion has a cylindrical main body part and an annular base part that is continued from the main body part of the ring finger portion toward a wrist; and the ring finger portion attaches to the pinky finger portion in the annular base part of the ring finger portion;

the middle finger portion has a cylindrical main body part and an annular base part that is continued from the main body part of the middle finger portion toward a wrist; and the middle finger portion attaches to the ring finger portion in the annular base part of the middle finger portion;

the index finger portion has a cylindrical main body part and an annular base part that is continued from the main body part of the index finger portion toward a wrist; and the index finger portion attaches to the middle finger portion in the an annular base part of the index finger portion;

the three finger trunk portion has a cylindrical main body part and an annular base part that is continued from the main body part of the three finger trunk portion toward a wrist; and the three finger trunk portion attaches to the pinky finger portion in the annular base part of the three finger trunk portion; and the thumb finger portion has a cylindrical main body part and an annular base part that is continued from the main body part of the thumb finger portion toward a wrist; and the thumb finger portion attaches to the four finger trunk portion in the annular base part of the thumb finger portion, the flat knitting machine having a large number of knitting needles each having at least one hook, the knitting needles being arranged in a front row and a rear row in a state in which the hooks of the respective rows face each other, wherein the front cloth is knitted by the knitting needles in the front row, and the rear cloth is knitted by the knitting needles in the rear row, wherein, in each of the front row and the rear row, the large number of knitting needles are sectioned into a thumb knitting needle group that knits the thumb portion, an index finger knitting needle group that knits the index finger portion, a middle finger knitting needle group that knits the middle finger portion, a ring finger knitting needle group that knits the ring finger portion, and a pinky finger knitting needle group that knits the pinky finger portion, the method comprising, successively:

a step of knitting the pinky finger portion;

a step of knitting the ring finger portion;

a step of knitting the middle finger portion after the step of knitting the ring finger portion;

a step of knitting the index finger portion after the step of knitting the middle finger portion;

a step of knitting the three finger trunk portion by means of a three finger trunk knitting needle group including the index finger knitting needle group, the middle finger knitting needle group, and the ring finger knitting needle group after the step of knitting the index finger portion;

a step of knitting the four finger trunk portion by means of a four finger trunk knitting needle group including the index finger knitting needle group, the middle finger knitting needle group, the ring finger knitting needle group, and the pinky finger knitting needle group after the step of knitting the pinky finger portion and the step of knitting the three finger trunk portion;

a step of knitting the thumb portion after the step of knitting the four finger trunk portion; and a step of knitting a five finger trunk portion by means of the thumb knitting needle group and the four finger trunk knitting needle group after the step of knitting the thumb portion, wherein:

the step of knitting the ring finger portion includes, successively, knitting of the cylindrical main body part of the ring finger portion, and knitting of the annular base part of the ring finger portion;

the step of knitting the middle finger portion includes, successively, knitting of the cylindrical main body part of the middle finger portion, and knitting of the annular base part of the middle finger portion; and the knitting of the annular base part in the step of knitting the middle finger portion includes, successively, knitting the front cloth of the annular base part by knitting needles in the front row, and knitting the rear cloth of the annular base part by the knitting needles in the rear row, wherein, in the knitting of the front cloth of the annular base part of the middle finger portion by the knitting needles in the front row, knitting needles for knitting the front cloth of the annular base part of the middle finger portion are:

knitting needles in the front row and in the middle finger knitting needle group; and at least one knitting needle that is in the front row and in the ring finger knitting needle group, that has been used for knitting of the main body part of the ring finger portion, and that is adjacent to the middle finger knitting needle group, wherein the at least one knitting needle that is for knitting the front cloth of the annular base part of the middle finger portion, that is, in the front row and in the ring finger knitting needle group, that has been used for knitting of the main body part of the ring finger portion, and that is adjacent to the middle finger knitting needle group, corresponds to at least two hooks, and wherein, in the knitting of the rear cloth of the annular base part of the middle finger portion by the knitting needles in the rear row, knitting needles for knitting the rear cloth of the annular base part of the middle finger portion are:

at least one knitting needle that is in the rear row and in the ring finger knitting needle group, that faces the at least one knitting needle for knitting the front cloth of the annular base part in the front row and in the ring finger knitting needle group, that has been used for knitting of the main body part of the ring finger portion, and that is adjacent to the middle finger knitting needle group; and knitting needles in the rear row and in the middle finger knitting needle group, wherein the at least one knitting needle that faces the at least one knitting needle that is for knitting the front cloth of the annular base part of the middle finger portion, that is in the front row and in the ring finger knitting needle group, that has been used for knitting of the main body part of the ring finger portion, and that is adjacent to the middle finger knitting needle group, corresponds to at least two hooks, the step of knitting the index finger portion includes, successively, knitting of the cylindrical main body part of the index finger portion, and knitting of the annular base part of the index finger portion; and the knitting of the annular base part in the step of knitting the index finger portion includes, successively, knitting the front cloth of the annular base part by knitting needles in the front row, and knitting the rear cloth of the annular base part by knitting needles in the rear row, wherein, in the knitting of the front cloth of the annular base part of the index finger portion by the knitting needles in the front row, knitting needles for knitting the front cloth of the annular base part of the index finger portion are:

knitting needles in the front row and in the index finger knitting needle group; and at least one knitting needle that is in the front row and in the middle finger knitting needle group, that has been used for knitting of the main body part of the middle finger portion, and that is adjacent to the index finger knitting needle group, wherein the at least one knitting needle that is for knitting the front cloth of the annular base part of the index finger portion, that is in the front row and in the middle finger knitting needle group, that has been used for knitting of the main body part of the middle finger portion, and that is adjacent to the index finger knitting needle group, corresponds to at least two hooks, and wherein, in the knitting of the rear cloth of the annular base part of the index finger portion by the knitting needles in the rear row, knitting needles for knitting the rear cloth of the annular base part of the index finger portion are:

at least one knitting needle that is in the rear row and in the middle finger knitting needle group, that faces the at least one knitting needle for knitting the front cloth of the annular base part in the front row and in the middle finger knitting needle group, that has been used for knitting of the main body part of the middle finger portion, and that is adjacent to the index finger knitting needle group; and knitting needles in the rear row and in the index finger knitting needle group, wherein the at least one knitting needle that faces the at least one knitting needle that is for knitting the front cloth of the annular base part of the index finger portion, that is in the front row and in the middle finger knitting needle group, that has been used for knitting of the main body part of the middle finger portion, and that is adjacent to the index finger knitting needle group, corresponds to at least two hooks, the step of knitting the three finger trunk portion includes, successively, knitting of a cylindrical main body part of the three finger trunk portion, and knitting of an annular base part of the three finger trunk portion; and the knitting of the annular base part in the step of knitting the three finger trunk portion includes, successively, knitting the front cloth of the annular base part by knitting needles in the front row, and knitting the rear cloth of the annular base part by knitting needles in the rear row, wherein, in the knitting of the front cloth of the annular base part of the three finger trunk portion by the knitting needles in the front row, knitting needles for knitting the front cloth of the annular base part of the three finger trunk portion are:

knitting needles in the front row and in the three finger trunk knitting needle group; and at least one knitting needle that is in the front row and in the pinky finger knitting needle group, that has been used for knitting of the main body part of the pinky finger portion, and that is adjacent to the ring finger knitting needle group, wherein the at least one knitting needle that is for knitting the front cloth of the annular base part of the ring finger portion, that is in the front row and in the pinky finger knitting needle group, that has been used for knitting of the main body part of the pinky finger portion, and that is adjacent to the ring finger knitting needle group, corresponds to at least two hooks, and wherein, in the knitting of the rear cloth of the annular base part of the three finger trunk portion by the knitting needles in the rear row, knitting needles for knitting the rear cloth of the annular base part of the three finger trunk portion are:

at least one knitting needle that is in the rear row and in the pinky finger knitting needle group, that faces the at least one knitting needle for knitting the front cloth of the annular base part in the front row and in the pinky finger knitting needle group, that has been used for knitting of the main body part of the pinky finger portion, and that is adjacent to the ring finger knitting needle group; and knitting needles in the rear row and in the three finger trunk knitting needle group, wherein the at least one knitting needle that faces the at least one knitting needle that is for knitting the front cloth of the annular base part of the ring finger portion, that is in the front row and in the pinky finger knitting needle group, that has been used for knitting of the main body part of the pinky finger portion, and that is adjacent to the ring finger knitting needle group, corresponds to at least two hooks, the step of knitting the thumb portion includes, successively, knitting of a cylindrical main body part of the thumb portion, and knitting of an annular base part of the thumb portion; and the knitting of the annular base part in the step of knitting the thumb portion includes, successively, knitting the front cloth of the annular base part by knitting needles in the front row, and knitting the rear cloth of the annular base part by knitting needles in the rear row, wherein, in the knitting of the front cloth of the annular base part of the thumb portion by the knitting needles in the front row, knitting needles for knitting the front cloth of the annular base part of the thumb portion are:

knitting needles in the front row and in the thumb knitting needle group; and at least one knitting needle that is in the front row and in the index finger knitting needle group, that has been used for knitting of the main body part of the index finger portion, and that is adjacent to the thumb knitting needle group, wherein the at least one knitting needle that is for knitting the front cloth of the annular base part of the thumb portion, in front row and in the index finger knitting needle group, that has been used for knitting of the main body part of the index finger portion, and that is adjacent to the thumb knitting needle group, corresponds to at least two hooks, and wherein, in the knitting of the rear cloth of the annular base part of the thumb portion by the knitting needles in the rear row, knitting needles for knitting the rear cloth of the annular base part of the thumb portion are:

at least one knitting needle that is in the rear row and in the index finger knitting needle group, that faces the at least one knitting needle for knitting the front cloth of the annular base part, in the front row and in the index finger knitting needle group, that has been used for knitting of the main body part of the index finger portion, and that is adjacent to the thumb knitting needle group; and knitting needles in the rear row and in the thumb knitting needle group, wherein the at least one knitting needle that faces the at least one knitting needle that is for knitting the front cloth of the annular base part of the thumb portion, that is in the front row and in the index finger knitting needle group, that has been used for knitting of the main body part of the index finger portion, and that is adjacent to the thumb knitting needle group, corresponds to at least two hooks, the method further comprising, after the knitting of the cylindrical main body part of the middle finger portion and the knitting of the annular base part of the middle finger portion, knitting of a first front and rear cloth connecting part that connects the front cloth and the rear cloth in the ring finger portion, wherein knitting needles for knitting the first front and rear cloth connecting part are:

the at least one knitting needle for knitting the front cloth of the annular base part in the knitting of the annular base part of the middle finger portion, that is in the front row and in the ring finger knitting needle group, that has been used for knitting of the main body part of the ring finger portion, and that is adjacent to the middle finger knitting needle group;

at least one knitting needle that is adjacent to the at least one knitting needle for knitting the front cloth of the annular base part, that is in the front row and in the first knitting needle group, that has been used for knitting of the main body part of the ring finger portion, and that is adjacent to the middle finger knitting needle group;

the at least one knitting needle that is in the rear row and in the ring finger knitting needle group, that faces the at least one knitting needle for knitting the front cloth of the annular base part in the front row and in the ring finger knitting needle group, that has been used for knitting of the main body part of the ring finger portion, and that is adjacent to the middle finger knitting needle group; and a knitting needle that is in the rear row and that is adjacent to the at least one knitting needle that faces the at least one knitting needle for knitting the front cloth of the annular base part in the front row and in the ring finger knitting needle group, that has been used for knitting of the main body part of the ring finger portion and that is adjacent to the middle finger knitting needle group.

4. A method for manufacturing a glove using a flat knitting machine, the glove being provided with a front cloth and a rear cloth constituting a plurality of portions covering hand fingers, the plurality of portions comprising a pinky finger portion, a ring finger portion adjacent to the pinky finger portion, a middle finger portion adjacent to the ring finger portion on an opposite side to the pinky finger portion, an index finger portion adjacent to the middle finger portion on an opposite side to the ring finger portion, a four finger trunk portion being consecutively provided from the index finger portion, the middle finger portion, the ring finger portion and the pinky finger portion toward a wrist, a thumb portion adjacent to the four finger trunk portion, and a five finger trunk portion being provided consecutively from the four finger trunk portion and the thumb portion toward a wrist, wherein:

the ring finger portion has a cylindrical main body part and an-annular base part that is continued from the main body part of the ring finger portion toward a wrist; and the ring finger portion attaches to the pinky finger portion in the annular base part of the ring finger portion;

the middle finger portion has a cylindrical main body part and an annular base part that is continued from the main body part of the middle finger portion toward a wrist; and the middle finger portion attaches to the ring finger portion in the an annular base part of the middle finger portion;

the index finger has a cylindrical main body part and an annular base part that is continued from the main body part of the index finger portion toward a wrist; and the index finger portion attaches to the middle finger portion in the an annular base part of the index finger portion; and the thumb portion has a cylindrical main body part and an annular base part that is continued from the main body part of the thumb finger portion toward a wrist; and the thumb finger portion attaches to the four finger trunk portion in the annular base part of the thumb finger portion, the flat knitting machine having a large number of knitting needles each having at least one hook, the knitting needles being arranged in a front row and a rear row in a state in which hooks of the respective rows face each other, wherein the front cloth is knitted by the knitting needles in the front row, and the rear cloth is knitted by the knitting needles in the rear row, wherein, in each of the front row and the rear row, the large number of knitting needles are sectioned into a thumb knitting needle group that knits the thumb portion, an index finger knitting needle group that knits the index finger portion, a middle finger knitting needle group that knits the middle finger portion, a ring finger knitting needle group that knits the ring finger portion, and a pinky finger knitting needle group that knits the pinky finger portion, the method comprising:

a step of knitting the pinky finger portion;

a step of knitting the ring finger portion after the step of knitting the pinky finger portion;

a step of knitting the middle finger portion after the step of knitting the ring finger portion;

a step of knitting the index finger portion after the step of knitting the middle finger portion;

a step of knitting the four finger trunk portion by means of a four finger trunk knitting needle group including the index finger knitting needle group, the middle finger knitting needle group, the ring finger knitting needle group and the pinky finger knitting needle group after the step of knitting the index finger portion;

a step of knitting the thumb portion after the step of knitting the four finger trunk portion; and a step of knitting a five finger trunk portion by means of the thumb knitting needle group and the four finger trunk knitting needle group after the step of knitting the thumb portion, wherein:

the step of knitting the ring finger portion includes, successively, knitting of a cylindrical main body part of the ring finger portion, and knitting of an annular base part of the ring finger portion; and the knitting of the annular base part in the step of knitting the ring finger portion includes, successively, knitting the front cloth of the annular base part by knitting needles in the front row, and knitting the rear cloth of the annular base part by knitting needles in the rear row, wherein, in the knitting of the front cloth of the annular base part of the ring finger portion by the knitting needles in the front row, knitting needles for knitting the front cloth of the annular base part of the ring finger portion are:

knitting needles in the front row and in the ring finger knitting needle group; and at least one knitting needle that is in the front row and in the pinky finger knitting needle group, that has been used for knitting of the main body part of the pinky finger portion, and that is adjacent to the ring finger knitting needle group, wherein the at least one knitting needle that is for knitting the front cloth of the annular base part of the ring finger portion, that is in the front row and in the pinky finger knitting needle group, that has been used for knitting of the main body part of the pinky finger portion, and that is adjacent to the ring finger knitting needle group, corresponds to at least two hooks, and knitting needles for knitting the rear cloth of the annular base part of the ring finger portion are:

at least one knitting needle that is in the rear row and in the pinky finger knitting needle group, that faces the at least one the knitting needle for knitting the front cloth of the annular base part in the front row and in the pinky finger knitting needle group, that has been used for knitting of the main body part of the pinky finger portion, and that is adjacent to the ring finger knitting needle group; and knitting needles in the rear row and in the ring finger knitting needle group, wherein the at least one knitting needle that faces the at least one knitting needle that is for knitting the front cloth of the annular base part of the ring finger portion, that is in the front row and in the pinky finger knitting needle group, that has been used for knitting of the main body part of the pinky finger portion, and that is adjacent to the ring finger knitting needle group, corresponds to at least two hooks, and wherein, in the knitting of the rear cloth of the annular base part of the ring finger portion by the knitting needles in the rear row, the step of knitting the middle finger portion includes, successively, knitting of a cylindrical main body part of the middle finger portion, and knitting of an annular base part of the middle finger portion, and the knitting of the annular base part in the step of knitting the middle finger portion includes, successively, knitting the front cloth of the annular base part by knitting needles in the front row, and knitting the rear cloth of the annular base part by knitting needles in and the rear row, wherein in the knitting of the front cloth of the annular base part of the middle finger portion by the knitting needles in the front row, knitting needles for knitting the front cloth of the annular base part of the middle finger portion are:

knitting needles in the front row and in the middle finger knitting needle group; and at least one knitting needle that is in the front row and in the ring finger knitting needle group, that has been used for knitting of the main body part of the ring portion, and that is adjacent to the middle finger knitting needle group, wherein the at least one knitting needle that is for knitting the front cloth of the annular base part of the middle finger portion, that is in the front row and in the ring finger knitting needle group, that has been used for knitting of the main body part of the ring finger portion, and that is adjacent to the middle finger knitting needle group, corresponds to at least two hooks, and wherein, in the knitting of the rear cloth of the annular base part of the middle finger portion by the knitting needles in the rear row, knitting needles for knitting the rear cloth of the annular base part of the middle finger portion are:

at least one knitting needle that is in the rear row and in the ring finger knitting needle group, that faces the at least one knitting needle for knitting the front cloth of the annular base part in the front row and in the ring finger knitting needle group, that has been used for knitting of the main body part of the ring finger portion, and that is adjacent to the middle finger knitting needle group; and knitting needles in the rear row and in the middle finger knitting needle group, wherein the at least one knitting needle that faces the at least one knitting needle that is for knitting the front cloth of the annular base part of the middle finger portion, that is in the front row and in the ring finger knitting needle group, that has been used for knitting of the main body part of the ring finger portion, and that is adjacent to the middle finger knitting needle group, corresponds to at least two hooks, the step of knitting the index finger portion includes, successively, knitting of a cylindrical main body part of the index finger portion, and knitting of an annular base part of the index finger portion; and the knitting of the annular base part in the step of knitting the index finger portion includes, successively, knitting the front cloth of the annular base part by knitting needles in the front row, and knitting the rear cloth of the annular base part by knitting needles in the rear row, wherein, in the knitting of the front cloth of the annular base part of the index finger portion by the knitting needles in the front row, knitting needles for knitting the front cloth of the annular base part of the index finger portion are:

knitting needles in the front row and in the index finger knitting needle group; and at least one knitting needle that is in the front row and in the middle finger knitting needle group, that has been used for knitting of the main body part of the middle finger portion, and that is adjacent to the index finger knitting needle group, wherein the at least one knitting needle that is for knitting the front cloth of the annular base part of the index finger portion, that is in the front row and in the middle finger knitting needle group, that has been used for knitting of the main body part of the middle finger portion, and that is adjacent to the index finger knitting needle group, corresponds to at least two hooks, and wherein, in the knitting of the rear cloth of the annular base part of the index finger portion by the knitting needles in the rear row, knitting needles for knitting the rear cloth of the annular base part of the index finger portion are:

at least one knitting needle that is in the rear row and in the middle finger knitting needle group, that faces the at least one knitting needle for knitting the front cloth of the annular base part in the front row and in the middle finger knitting needle group, that has been used for knitting of the main body part of the middle finger portion, and that is adjacent to the index finger knitting needle group; and knitting needles in the rear row and in the index finger knitting needle group, wherein the at least one knitting needle that faces the at least one knitting needle that is for knitting the front cloth of the annular base part of the index finger portion, that is in the front row and in the middle finger knitting needle group, that has been used for knitting of the main body part of the middle finger portion, and that is adjacent to the index finger knitting needle group, corresponds to at least two hooks;

the step of knitting the thumb portion includes, successively, knitting of a cylindrical main body part of the thumb portion, and knitting of an annular base part of the thumb portion; and the knitting of the annular base part in the step of knitting the thumb portion forming step includes, successively, knitting the front cloth of the annular base part by knitting needles in the front row, and knitting the rear cloth of the annular base part by knitting needles in the rear row, wherein, in the knitting of the front cloth of the annular base part of the thumb portion by the knitting needles in the front row, knitting needles for knitting the front cloth of the annular base part of the thumb portion are:

knitting needles the front row and in the thumb knitting needle group; and at least one knitting needle that is in the front row and in the index finger knitting needle group, that has been used for knitting of the main body part of the index finger portion, and that is adjacent to the thumb knitting needle group, wherein the at least one knitting needle that is for knitting the front cloth of the annular base part of the thumb portion, that is in the front row and in the index finger knitting needle group, that has been used for knitting of the main body part of the index finger portion, and that is adjacent to the thumb knitting needle group, corresponds to at least two hooks, and wherein, in the knitting of the rear cloth of the annular base part of the thumb portion by the knitting needles in the rear row, knitting needles for knitting the rear cloth of the annular base part of the thumb portion are:

at least one knitting needle that is in the rear row and in the index finger knitting needle group, that faces the at least one knitting needle for knitting the front cloth of the annular base part in the front row and in the index finger knitting needle group, that has been used for knitting of the main body part of the index finger portion, and that is adjacent to the thumb knitting needle group; and knitting needles in the rear row and in the thumb knitting needle group, wherein the at least one knitting needle that faces the at least one knitting needle that is for knitting the front cloth of the annular base part of the thumb portion, that is in the front row and in the index finger knitting needle group, that has been used for knitting of the main body part of the index finger portion, and that is adjacent to the thumb knitting needle group, corresponds to at least two-hooks, the method further comprising, after the knitting of the cylindrical main body part of the middle finger portion and the knitting of the annular base part of the middle finger portion, knitting of a first front and rear cloth connecting part that connects the front cloth and the rear cloth in the ring finger portion, wherein knitting needles for knitting the first front and rear cloth connecting part are:

the at least one knitting needle for knitting the front cloth of the annular base part in the knitting of the annular base part of the middle finger portion; that is in the front row and in the ring finger knitting needle group, that has been used for knitting of the main body part of the ring finger portion, and that is adjacent to the middle finger knitting needle group;

at least one knitting needle that is adjacent to the at least one knitting needle for knitting the front cloth of the annular base part, that is in the front row and in the first knitting needle group, that has been used for knitting of the main body part of the ring finger portion, and that is adjacent to the middle finger knitting needle group;

the at least one knitting needle that is in the rear row and in the ring finger knitting needle group, that faces the at least one knitting needle for knitting the front cloth of the annular base part in the front row and in the ring finger knitting needle group, that has been used for knitting of the main body part of the ring finger portion, and that is adjacent to the middle finger knitting needle group; and a knitting needle that is in the rear row and that is adjacent to the at least one knitting needle that faces the at least one knitting needle for knitting the front cloth of the annular base part in the front row and in the ring finger knitting needle group, that has been used for knitting of the main body part of the ring finger portion and that is adjacent to the middle finger knitting needle group.

5. A method for manufacturing a coated glove comprising:

the method for manufacturing a glove according to claim 1, and further comprising:

a step of forming a coating layer at least in a palm region of a glove manufactured by the method for manufacturing a glove.

6. A glove comprising a front cloth and a rear cloth each constituted of a plurality of stitches, in which a portion for a trunk and a plurality of portions for fingers that corresponds to respective fingers and is provided to protrude from the portion for a trunk toward a fingertip side are composed of the front cloth and the rear cloth, wherein:

the portion for a trunk and the plurality of portions for fingers each include a cylindrical main body part and an annular base part that is continued from the cylindrical main body part toward a wrist;

the annular base part of at least any one portion among the portion for a trunk and the plurality of portions for fingers includes:

a front face portion that is constituted of the front cloth;

a portion-connecting front side portion that is constituted of the front cloth and connected to the annular base part of another portion adjacent to a first side of the one portion;

a portion-connecting rear side portion that is constituted of the rear cloth and connected to the annular base part of another one portion adjacent to a first side of the one portion; and a rear face portion that is constituted of the rear cloth, the front face portion being continued from the front cloth in the cylindrical main body part of the one portion toward a wrist;

the portion-connecting front side portion being continued from the front face portion in a direction perpendicular to a wrist-to-fingertip direction, and being continued from at least two stitches on a second side among the plurality of stitches of the front cloth of the annular base part of the another portion which is adjacent to the first side of the one portion toward a wrist, the portion-connecting rear side portion being continued from the portion connecting front side portion in a direction perpendicular to the wrist-to-fingertip direction, and being continued from at least two stitches on the second side among the plurality of stitches of the rear cloth of the annular base part of the another portion which is adjacent to the first side of the one portion toward a wrist, and the rear face portion being continued from the portion-connecting rear side portion in a direction perpendicular to the wrist-to-fingertip direction, and being continued from the rear cloth of the cylindrical main body part of the one portion toward a wrist, the glove further comprising, between the portions, a front and rear cloth connecting part that connects the front cloth and the rear cloth, wherein the front and rear cloth connecting part is formed in a different course than that of the knitting of the annular base part, and connects each of the annular base parts on a front cloth side and on a rear cloth side with respect to the front and rear cloth connecting part, and the front and rear cloth connecting part is provided more on a wrist side than the front face portion, the portion-connecting front side portion in a direction perpendicular to the wrist-to-fingertip direction, the portion-connecting rear side portion in a direction perpendicular to the wrist-to-fingertip direction, and the rear face portion.

7. The glove according to claim 6, wherein the front and rear cloth connecting part is provided in a wale direction of the portion connecting front side portion in a direction perpendicular to the wrist-to-fingertip direction and the portion-connecting rear side portion in a direction perpendicular to the wrist-to-fingertip direction.

8. The glove according to claim 6, wherein the annular base part of at least two portions respectively has the front face portion, the portion-connecting front side portion in a direction perpendicular to the wrist-to-fingertip direction, the portion-connecting rear side portion in a direction perpendicular to the wrist-to-fingertip direction, the rear face portion and the front and rear cloth connecting part, and the front and rear cloth connecting part of the annular base part of the at least two portions is provided in the same course.

9. A coated glove comprising:

the glove according to claim 6; and a coating layer that is formed at least in a palm region of the glove.

* * * * *